US011076733B2

(12) United States Patent
Yagur et al.

(10) Patent No.: US 11,076,733 B2
(45) Date of Patent: Aug. 3, 2021

(54) METHOD AND APPARATUS FOR ATTACHING A FLOOR TOOL TO A VACUUM FRAME

(71) Applicant: Dynamic Diamond Tooling, Orlando, FL (US)

(72) Inventors: Ron Yagur, Lake Mary, FL (US); Patrick Pollitt, Orlando, FL (US)

(73) Assignee: DYNAMIC CONCRETE, LLC, Orlando, FL (US)

( * ) Notice: Subject to any disclaimer, the term of this patent is extended or adjusted under 35 U.S.C. 154(b) by 304 days.

(21) Appl. No.: 15/862,744

(22) Filed: Jan. 5, 2018

(65) Prior Publication Data

US 2018/0192838 A1 Jul. 12, 2018

Related U.S. Application Data

(60) Provisional application No. 62/443,359, filed on Jan. 6, 2017.

(51) Int. Cl.

| | |
|---|---|
| ***A47L 9/06*** | (2006.01) |
| ***A47L 5/24*** | (2006.01) |
| ***A47L 9/00*** | (2006.01) |

(Continued)

(52) U.S. Cl.

CPC ..... *A47L 9/0666* (2013.01); *A47L 5/24* (2013.01); *A47L 5/365* (2013.01); *A47L 9/009* (2013.01);

(Continued)

(58) Field of Classification Search

CPC . A47L 9/0666; A47L 9/02; A47L 9/10; A47L 5/365; A47L 5/24; A47L 9/009; A47L 9/248; E01H 1/0835

(Continued)

(56) References Cited

U.S. PATENT DOCUMENTS 1,923,689 A * 8/1933 Rosenberg ..... A47L 11/30 15/320
2,193,784 A * 3/1940 Smith ..... A47L 5/32 15/301

(Continued)

FOREIGN PATENT DOCUMENTS

AU 462011 B2 * 5/1975 ..... E01H 1/0836
KR 19990030979 U * 7/1999
KR 101589274 B1 * 1/2016

OTHER PUBLICATIONS

Translation of Korean Patent (KR19990030979U), retrieved from Google patents on Jun. 19, 2020 (Year: 1999).*

(Continued)

*Primary Examiner* — Laura C Guidotti
*Assistant Examiner* — Thomas Raymond Rodgers
(74) *Attorney, Agent, or Firm* — Cian G. O'Brien; John L. DeAngelis; Wolter, Van Dyke, Davis, PLLC

(57) ABSTRACT

An apparatus is provided for attaching floor tools to a wheeled vehicle. The apparatus includes a mounting frame configured to secure to a frame of the wheeled vehicle and a floating frame rotatably attached to the mounting frame. The apparatus also includes pickup tubes attached to the floating frame. The pickup tubes are configured to attach to the floor tools. The floating frame is configured to move relative to the mounting frame based on undulations in a floor surface over which the floor tools travel. In other embodiments, a method is provided for assembling the apparatus. In still other embodiments, a method is provided for using the above apparatus with the wheeled vehicle. In still other embodiments, a wheeled vehicle is provided that includes the above apparatus and the one or more floor tools attached to the wheeled vehicle with the apparatus.

23 Claims, 17 Drawing Sheets

(51) Int. Cl.
*A47L 9/24* (2006.01)
*A47L 9/02* (2006.01)
*A47L 9/10* (2006.01)
*A47L 5/36* (2006.01)

(52) U.S. Cl.
CPC ..... *A47L 9/02* (2013.01); *A47L 9/10* (2013.01); *A47L 9/248* (2013.01)

(58) Field of Classification Search
USPC ..... 15/354–359
See application file for complete search history.

(56) References Cited

U.S. PATENT DOCUMENTS 2,973,544 A * 3/1961 Romaniuk ..... E01H 1/0836 15/359
3,948,549 A * 4/1976 Duran ..... E05B 67/365 292/26
4,333,203 A 6/1982 Yonkers
4,845,801 A * 7/1989 Milly ..... E01H 1/103 15/321
5,294,063 A * 3/1994 Bote ..... A01G 3/002 15/329
5,301,388 A * 4/1994 Zeren ..... B08B 5/04 15/327.1
6,360,408 B1 * 3/2002 Dykstra ..... F16B 45/04 24/115 G
6,530,117 B2 3/2003 Peterson
6,964,081 B1 * 11/2005 Clement ..... A47L 11/302 15/320
7,877,839 B2 2/2011 Phelan
8,060,977 B2 * 11/2011 Stephens ..... A47L 5/32 15/323
8,448,293 B2 5/2013 Sepke
8,997,905 B2 * 4/2015 Johnson ..... A47L 11/4061 180/65.1
2009/0307866 A1 * 12/2009 Witter ..... A47L 9/1683 15/353
2011/0049914 A1 * 3/2011 Beaird, III ..... B66D 1/28 293/115

OTHER PUBLICATIONS

Translation of KR-101589274-B1 retrieved from Espaceneton Jan. 27, 2021 (Year: 2016).*
https://tomadovac.com/store/product.aspx?pid=262.

* cited by examiner

METHOD AND APPARATUS FOR ATTACHING A FLOOR TOOL TO A VACUUM FRAME

CROSS-REFERENCE TO RELATED APPLICATIONS

This application claims benefit of Provisional Appln. 62/443,359, filed Jan. 6, 2017, the entire contents of which are hereby incorporated by reference as if fully set forth herein, under 35 U.S.C. § 119(e).

BACKGROUND

FIG. 1 illustrates a conventional squeegee vacuum 100 with an apparatus 104 to attach a floor tool 102 to a frame of the vacuum 100. One example of the conventional squeegee vacuum 100 is Trot-Mop™ design manufactured by Tornado® Vacuum of Chicago, Ill. Since the floor tool 102 is attached to the frame of the squeegee vacuum 100, the user pushes the vacuum 100 and floor tool 102 as a single unit. This arrangement overcomes disadvantages of conventional vacuums with hand-held vacuum wands including a hose attached to the floor tool 102, where the floor tool 102 and vacuum 100 must be moved individually.

SUMMARY

In a first set of embodiments, an apparatus is provided for attaching one or more floor tools to a wheeled vehicle. The apparatus includes a mounting frame configured to secure to a frame of the wheeled vehicle and a floating frame rotatably attached to the mounting frame. The apparatus also includes one or more pickup tubes attached to the floating frame. The one or more pickup tubes are configured to attach to the one or more floor tools. The floating frame is configured to move relative to the mounting frame based on undulations in a floor surface over which the one or more floor tools travel.

In a second set of embodiments, a method is provided for assembling the above apparatus.

In a third set of embodiments, a method is provided for using the above apparatus with the wheeled vehicle.

In a fourth set of embodiments, a wheeled vehicle is provided that includes the above apparatus and the one or more floor tools attached to the wheeled vehicle with the apparatus.

Still other aspects, features, and advantages are readily apparent from the following detailed description, simply by illustrating a number of particular embodiments and implementations, including the best mode contemplated for carrying out the invention. Other embodiments are also capable of other and different features and advantages, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

Embodiments are illustrated by way of example, and not by way of limitation, in the figures of the accompanying drawings in which like reference numerals refer to similar elements and in which.

DETAILED DESCRIPTION

Figure 1:
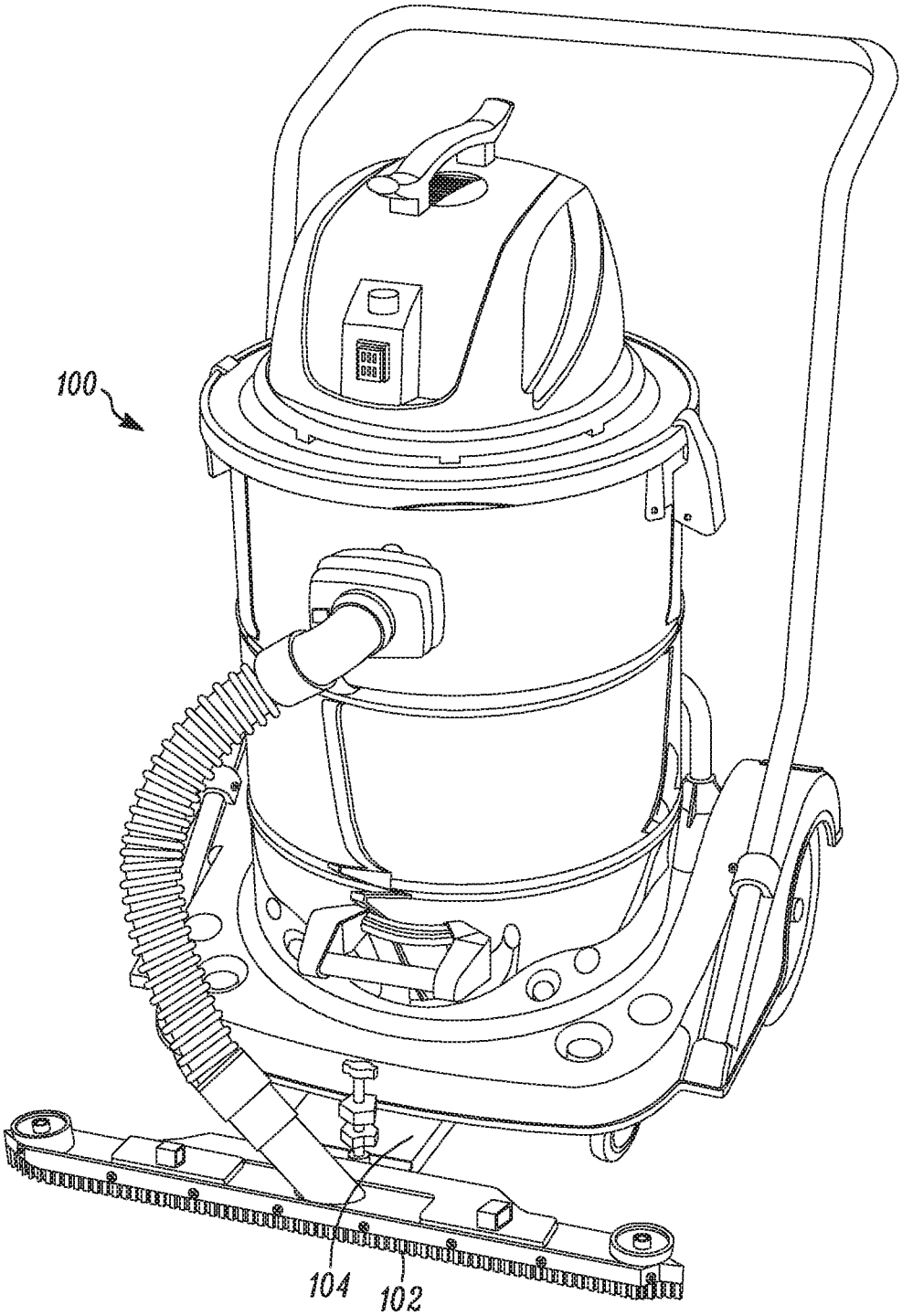
(PRIOR ART) FIG. 1
FIG. 1 is a perspective view that illustrates a floor tool attached to a conventional vacuum.

The inventors of the present invention recognized that the conventional squeegee vacuum 100 of FIG. 1 has several drawbacks. The squeegee vacuum 100 is a shop vac or wet/dry vacuum design with limited filtering ability. As appreciated by one skilled in the art, when the filter of the conventional squeegee vacuum 100 is full, the user must stop the squeegee vacuum 100 and remove the filter, thereby exposing the user to dust, including silicate dust or other harmful material. Another drawback of the squeegee vacuum 100 is that is has a filter with limited surface area and thus can only run for a limited time before the filter clogs, preventing any additional suction and requiring that the filter be cleaned. The inventors of the present invention recognized that other vacuum designs without these filtering drawbacks do not have an apparatus to attach a floor tool to a frame of the vacuum. Thus, the inventors of the present invention recognized that it would be advantageous to develop an apparatus to attach a floor tool to the frame of these other vacuum designs.

The inventors of the present invention also recognized that the conventional squeegee vacuum 100 is limited to attaching a single floor tool 102 to the frame of the squeegee vacuum 100. The inventors of the present invention recognized that this arrangement is limiting, since the single floor tool 102 has limited ability to adjust to various undulations in the floor. Thus, the inventors of the present invention developed an apparatus for attaching multiple floor tools to the frame of a vacuum, where each floor tool can independently adjust to undulations in the floor.

Additionally, the inventors recognized that conventional vacuums with a hand held wand including a hose attached to a floor tool is limiting, since the user cannot keep the floor tool in a perfectly horizontal position as the user moves the wand back and forth during a stroke. The inventors specifically recognized that when the user moves the wand back and forth, the user will frequently tilt the floor tool up (i.e. elbow down) when pushing the wand and will frequently tilt the floor tool down (i.e. lifts elbow) when pulling the wand during a stroke. Consequently, the floor tool follows an arcuate path during the stroke and thus does not maintain a perfect horizontal position over the floor surface. The inventors of the present invention recognized that if an apparatus was developed that mounts the floor tool to the frame of the vacuum, this apparatus would maintain the floor tool in the horizontal position during an entire path of travel over a floor surface.

The inventors of the present invention also recognized that the apparatus 104 secures the floor tool 102 to only the frame of the squeegee vacuum 100. The inventors of the present invention recognized that this arrangement is limiting, since the floor tool 102 cannot be detached from the frame of the squeegee vacuum 100 and attached to a different model vacuum, for example. Thus, the inventors of the present invention developed an accessory for attaching a floor tool to a plurality of vacuum frames as well as a plurality of pre-separator frames. Additionally, the inventors of the present invention advantageously developed the accessory that can be easily attached to the plurality of frames without the need for tools.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements at the time of this writing. Furthermore, unless otherwise clear from the context, a numerical value presented herein has an implied precision given by the least significant digit. Thus a value 1.1 implies a value from 1.05 to 1.15. The term "about" is used to indicate a broader range centered on the given value, and unless otherwise clear from the context implies a broader range around the least significant digit, such as "about 1.1" implies a range from 1.0 to 1.2. If the least significant digit is unclear, then the term "about" implies a factor of two, e.g., "about X" implies a value in the range from 0.5X to 2X, for example, about 100 implies a value in a range from 50 to 200. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Figure 2A:
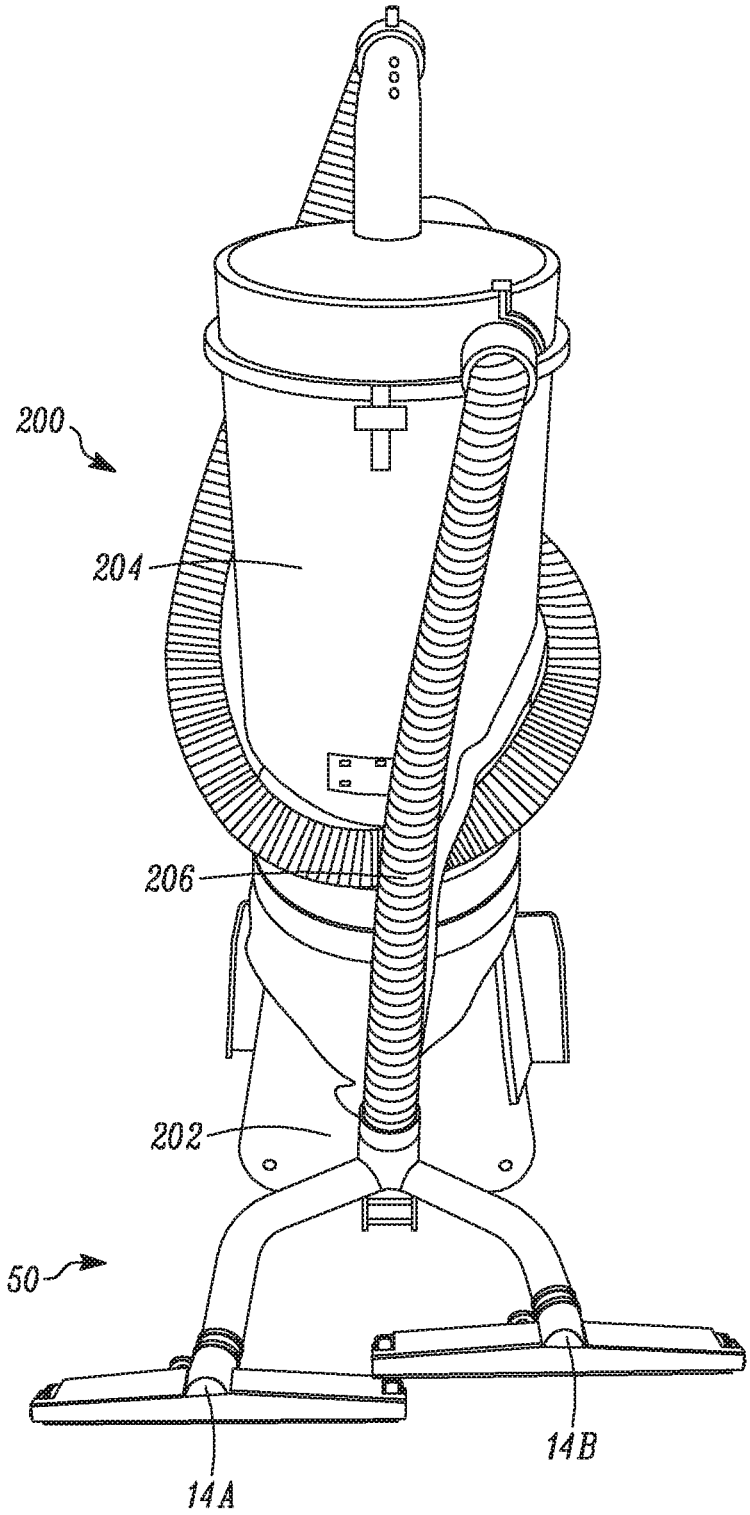
FIG. 2A is a front view that illustrates an example of an apparatus attaching a pair of floor tools to a frame of a pre-separator, according to one embodiment.

FIG. 2A is a front view that illustrates an example of an apparatus 50 attaching a pair of floor tools 14*a*, 14*b* to a frame 202 of a pre-separator 200, according to one embodiment. In some embodiments, for purposes of this invention "pre-separator" shall mean a pre-separator with specifications that are similar to pre-separators manufactured by Pullman Ermator® of Tampa, Fla. In an example embodiment, for purposes of this invention "pre-separator" shall mean a pre-separator with specifications that are similar to the C3000 Pre-Separator manufactured by Pullman Ermator® of Tampa, Fla. The inventors of the present invention recognized that one of the drawbacks of conventional pre-separators is that they easily tip over. The inventors recognized that by using the apparatus 50 to attach the pair of floor tools 14*a*, 14*b* to the frame 202 of the pre-separator 200, the pre-separator 200 would now be much more stable since the floor tools 14*a*, 14*b* in contact with the floor surface will prevent the pre-separator 200 from being tipped over.

As depicted in FIG. 2A, an inlet end of a duct 206 is attached to the apparatus 50, to receive dust vacuumed off the floor by the floor tools 14*a*, 14*b*. In one embodiment, the inlet end of the duct 206 is attached to the junction tube 84 of the apparatus 50. An outlet end of the duct 206 is attached to an inlet of a drum 204 of the pre-separator 200. As appreciated by one skilled in the art, the drum 204 includes curled pieces of metal. A vacuum connected to the pre-separator 200 creates a cyclonic effect when suction is pulled through the pre-separator 200. In some embodiments, due to the cyclonic effect within the drum 204, approximately 80% of the dust and heavier materials drop into a collection area below the drum 204 and thus these materials are not passed to the vacuum. As a result, the vacuum only receives and filters light dust material from the pre-separator 200 that did not drop into the collection area. Consequently, the pre-separator 200 extends the useful life of vacuum filters by removing 80% of dust and heavier materials upstream of the vacuum. As a result, the vacuum filter does not need to be cleaned for an extended time, which increases the run time tremendously. Additionally, the pre-separator 200 saves the vacuum filter from damage, including damage due to larger material impacting the filter.

A bag is connected under the drum 204 in the collection area and is used to collect the removed materials. In some embodiments, the bag is a Longopac® dust collection sausage plastic bag. When the user wants to dump the bag, the user tie wraps the portion of the bag containing the collected dust and cuts the bag. This advantageously protects the user from exposure to harmful silicate dust or other material and leaves a bag in the collection area to collect dust material at a later time.

In some embodiments, where the pre-separator 200 is connected to a vacuum downstream of the pre-separator 200, the apparatus 50 is attached to a frame of the combined pre-separator and vacuum. In these embodiments, the inventors of the present invention recognized that a user is advantageously able to move the vacuum and pre-separator as one unit with only one vacuum hose needed instead of two vacuum hoses. In an example embodiment where a combined pre-separator and vacuum are used with a concrete grinder, one vacuum hose is connected from the vacuum to the pre-separator and a second vacuum hose is connected from the grinder to the pre-separator. The inventors recognized that one advantage of using the apparatus 50 with this combined pre-separator/vacuum arrangement is that the pre-separator 200 allows for heavy particulates to be vacuumed or picked up and 80% of that material does not even make it to the vacuum which extends the life of the vacuum filter.

Figure 2B:
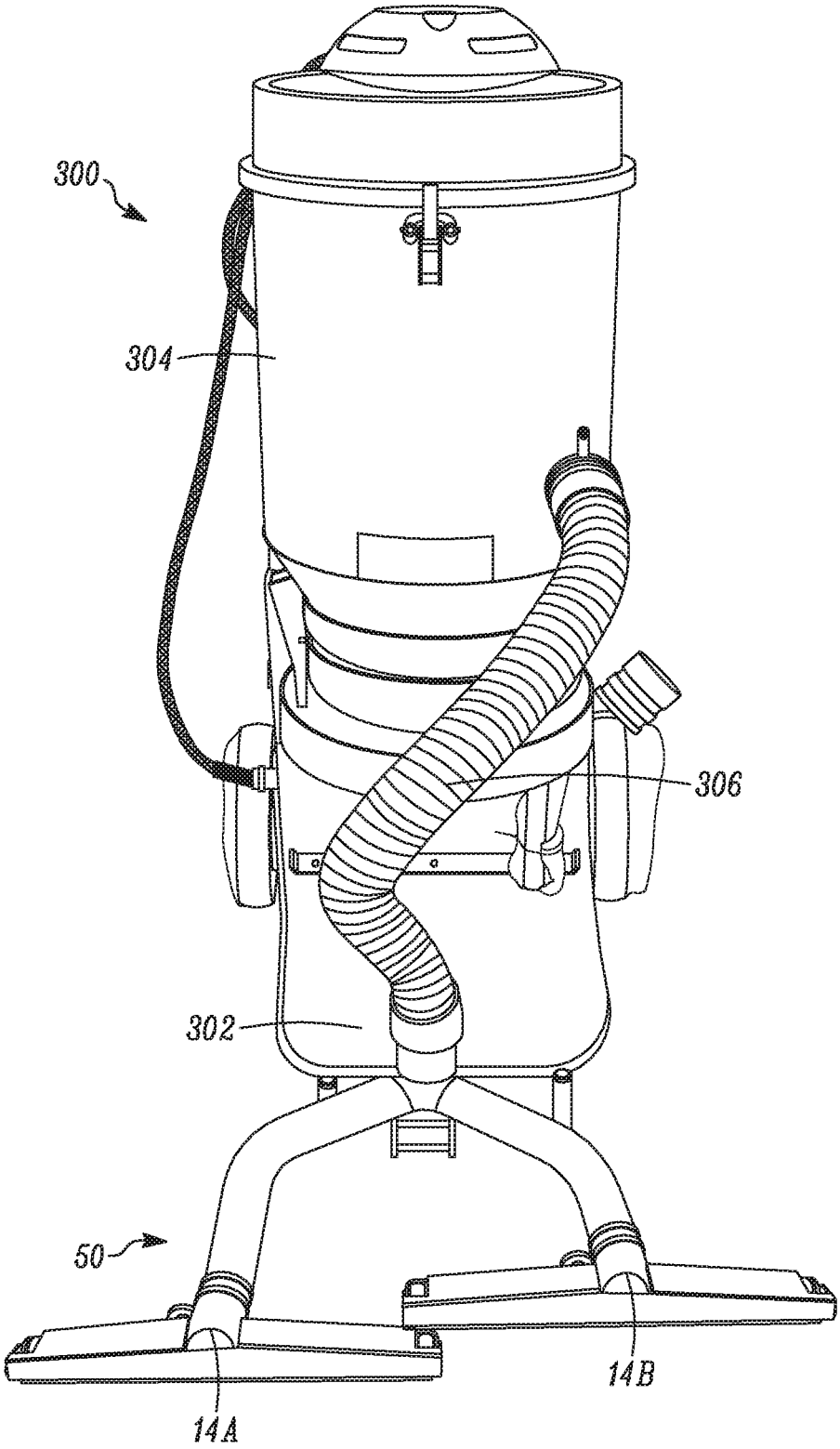
FIG. 2B is a front view that illustrates an example of an apparatus attaching a pair of floor tools to a frame of a vacuum, according to one embodiment.
Figure 2C:
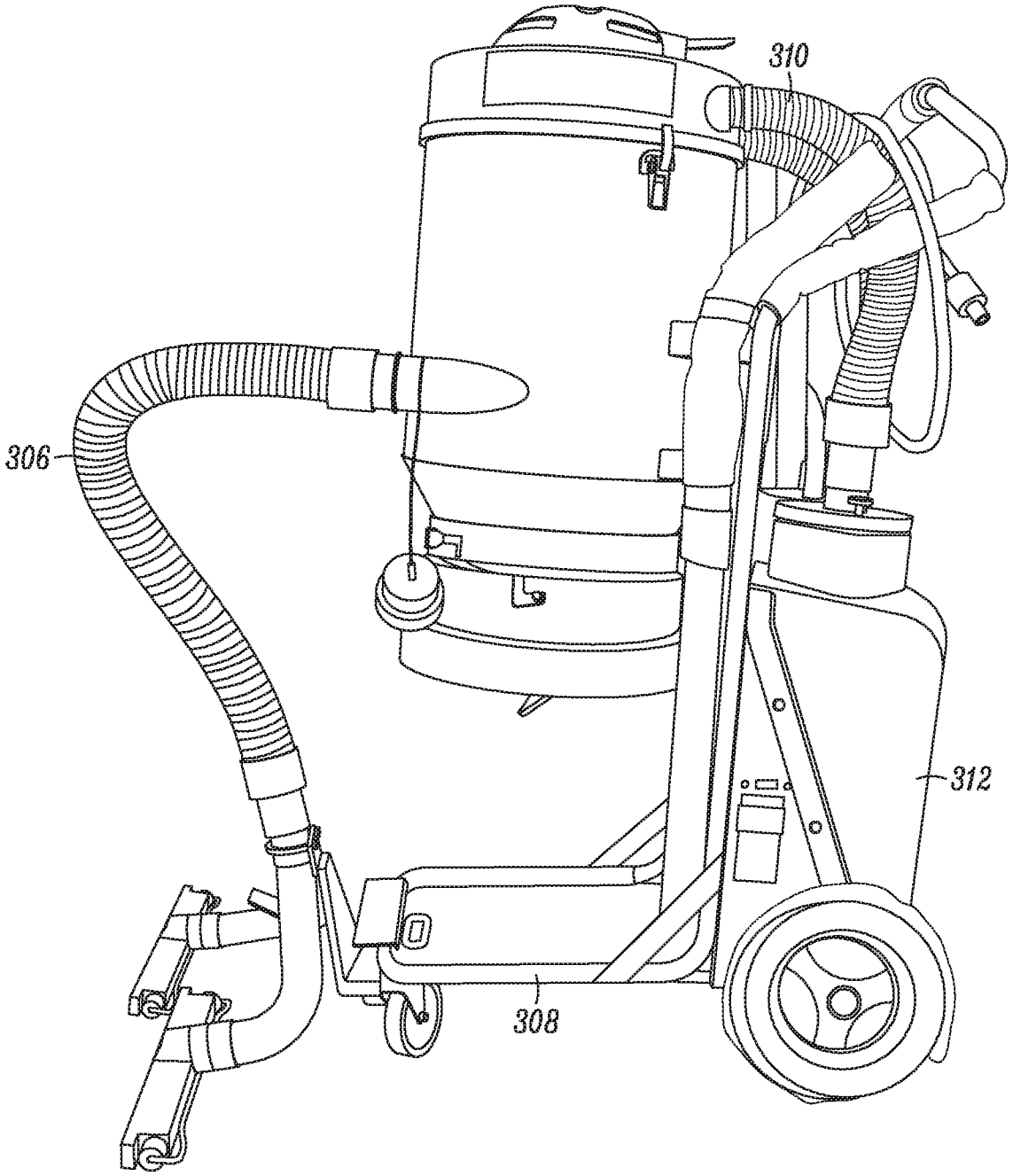
FIG. 2C is a side view of the apparatus of FIG. 2B.

FIG. 2B is a front view that illustrates an example of the apparatus 50 attaching the pair of floor tools 14*a*, 14*b* to a frame 302 of a vacuum 300, according to one embodiment. FIG. 2C is a side view of the apparatus 50 of FIG. 2B. In some embodiments, for purposes of this invention "vacuum" shall mean a vacuum with a minimum suction capability of 150 cubic feet per minute (CFM). In other embodiments, for purposes of this invention "vacuum" shall mean a vacuum with a minimum suction capability of 200 cubic feet per minute (CFM). In still other embodiments, for purposes of this invention "vacuum" shall mean a vacuum with a minimum water lift of 90". In one embodiment, for purposes of this invention "vacuum" shall mean a vacuum with specifications that are similar to vacuums manufactured by Pullman Ermator® of Tampa, Fla. In an example embodiment, for purposes of this invention "vacuum" shall mean a vacuum with specifications that are similar to the S26 HEPA Dust Extractor manufactured by Pullman Ermator® of Tampa, Fla. In other embodiments, for purposes of this invention, "vacuum" shall mean a vacuum that is only a dry vacuum and excludes a wet vacuum or a wet/dry vacuum. In still other embodiments, for purposes of this invention, "vacuum" shall mean a vacuum with 2 or 3 motors. In still other embodiments, for purposes of this invention, "vacuum" shall mean a vacuum with a high efficiency particulate air (HEPA) filter.

As depicted in FIG. 2B, an inlet end of a duct 306 is attached to the apparatus 50 (e.g. to the junction tube 84), to receive dust vacuumed off the floor by the floor tools 14*a*, 14*b*. An outlet end of the duct 306 is attached to an inlet of a drum 304 of the vacuum 300. A filter (not shown) is positioned within the drum 304 to filter larger sized particles. To clean the filter, the vacuum 300 is left running, as the inlet to the drum 304 is temporarily blocked and a lever (not shown) is pressed one or more times. This causes air to flow in through the top of the drum 304, which causes dust in the filter to fall into a bag (not shown) connected to a base of the drum 304. In some embodiments, the vacuum sucks air and dust against the outside area of a conical filter or long hollow socks. So as long as the suction is on, the outside of the filter or socks collect dust. To clean the filter, the suction is stopped by blocking the inlet to the drum 304 and opening airflow into the middle or center of the conical filters or socks. This airflow pushes the dust off the outside of the filter or socks and allows it to fall into the bag connected to the base of the drum 304. This advantageously permits the filter to be cleaned while the vacuum 300 remains running. Another advantage of this arrangement is that the user has no exposure to the silicate dust or other particulates as the filter is being cleaned. This is distinct from the squeegee vacuum 100 which requires that the squeegee vacuum 100 be stopped to clean the filter and where the user is exposed to dust from the filter. The inventors recognized that some conventional vacuums (e.g. pulse vacs) have an automatic feature that cleans the filter by using a compressor attached to the vacuum motor(s). The pulse vac automatically shuts the suction off and uses the compressor to blow a shot or two of air into the filter, thereby cleaning it automatically. However, the inventors of the present invention recognized drawbacks of pulse vacs. For example, when the compressor dies, the vacuum is down since there is no way to manually clean the filter without exposing oneself to harmful mounds of dust.

The bag (not shown) can be continuously extended and a pair of plastic ties can be tightened around the bag and the bag can be cut at a region between the ties, to conveniently remove a portion of the bag with collected dust. A second duct 310 passes smaller particles not filtered by the drum 304 filter to a housing 312 that contains multiple high-efficiency particulate air (HEPA) filters. The inventors of the present invention noted that some conventional methods for collecting dust involve using a squeegee to move the dust into a large pile and then shoveling the silicate dust into a garbage bag. The inventors of the present invention noticed that this presents employees with a health hazard as silicate dust is very harmful. The vacuums and pre-separators manufactured by Ermator® utilize a sausage bag as the dust is collected and the user can replace the dust bag without being exposed to any harmful silicate.

Figure 2D:
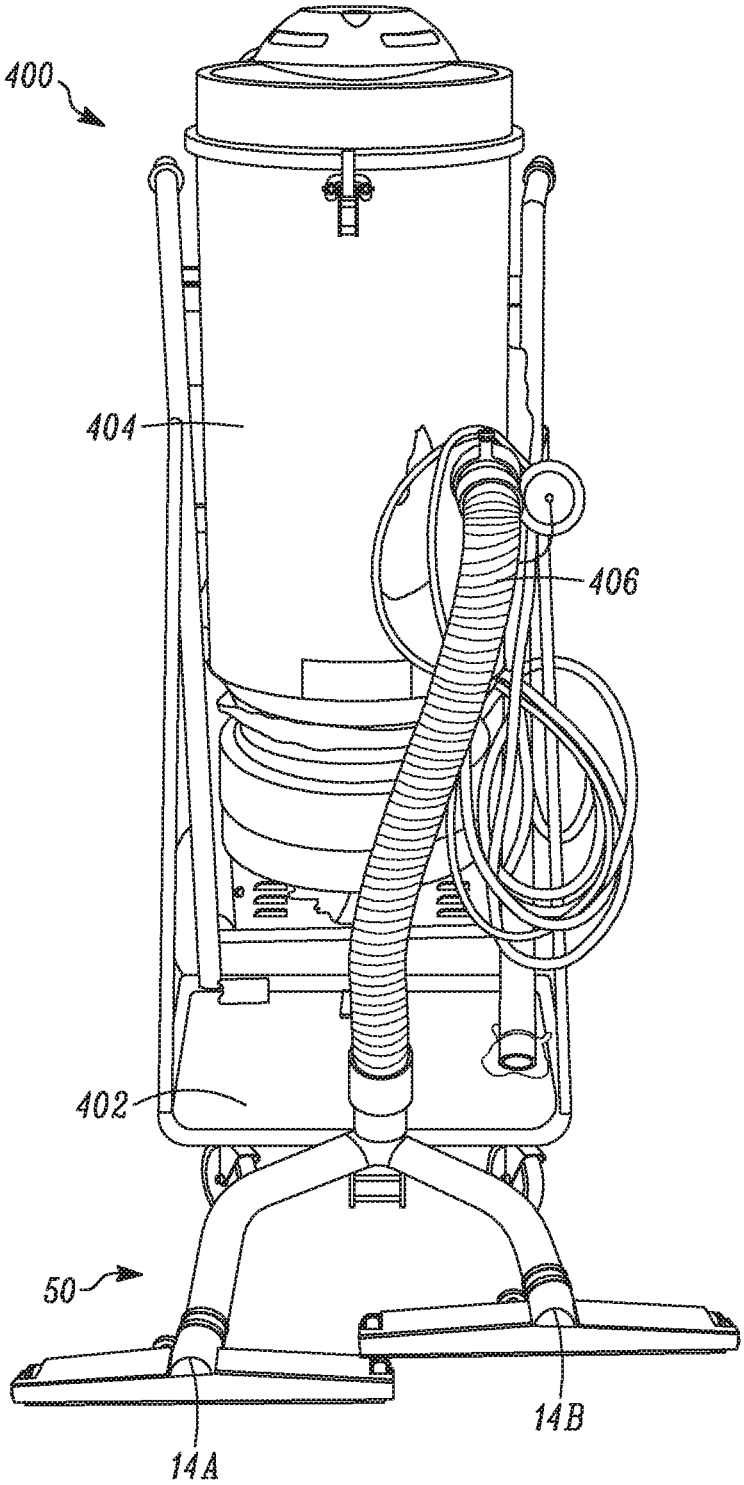
FIG. 2D is a front view that illustrates an example of an apparatus attaching a pair of floor tools to a frame of a vacuum, according to one embodiment.
Figure 2E:
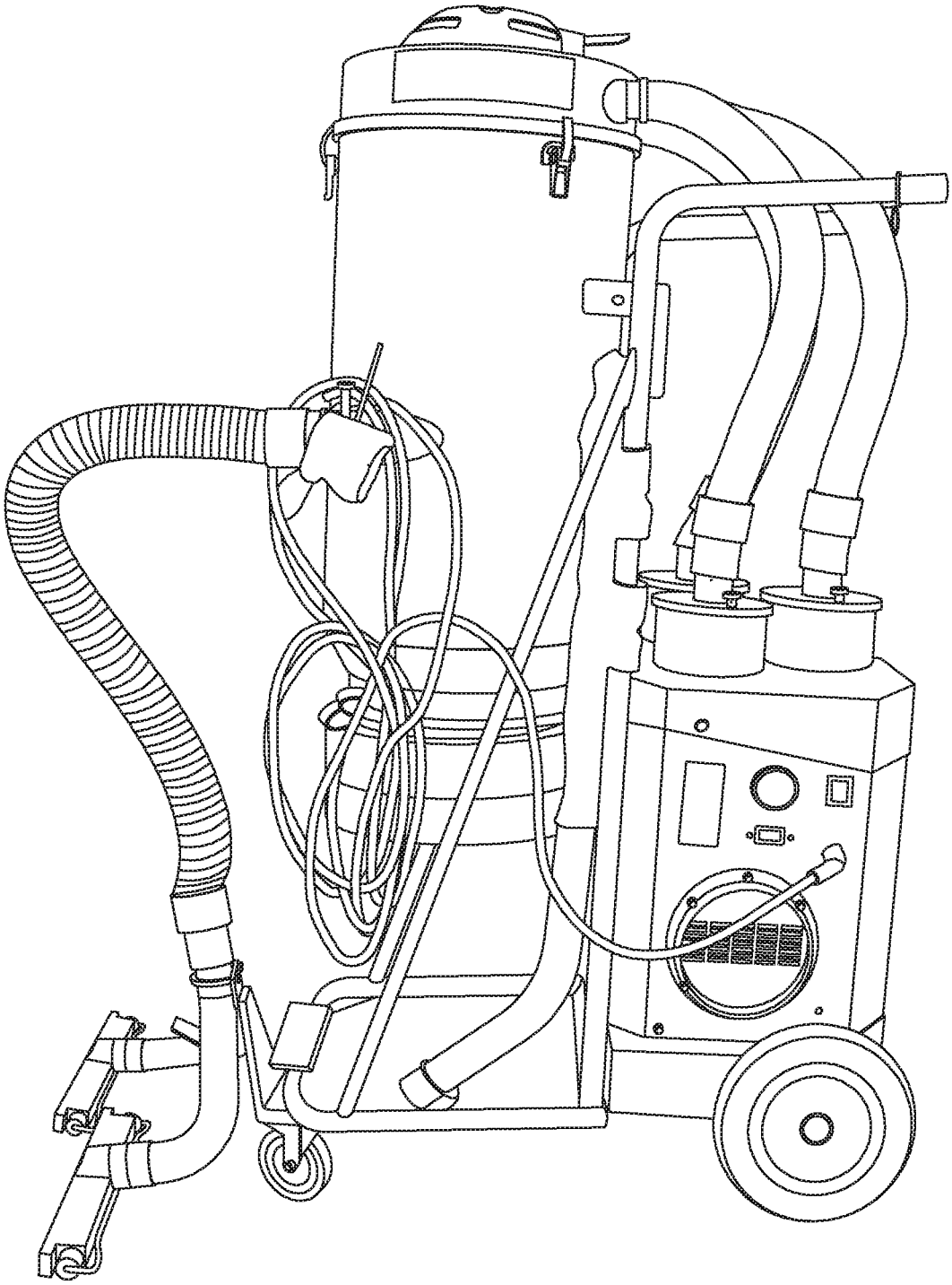
FIG. 2E is a side view of the apparatus of FIG. 2D.

FIG. 2D is a front view that illustrates an example of the apparatus 50 attaching the pair of floor tools 14*a*, 14*b* to a frame 402 of a vacuum 400, according to one embodiment. FIG. 2E is a side view of the apparatus 50 of FIG. 2D. In an example embodiment, for purposes of this invention "vacuum" shall mean a vacuum with specifications that are similar to the S36 HEPA Dust Extractor manufactured by Pullman Ermator® of Tampa, Fla.

Figure 2F:
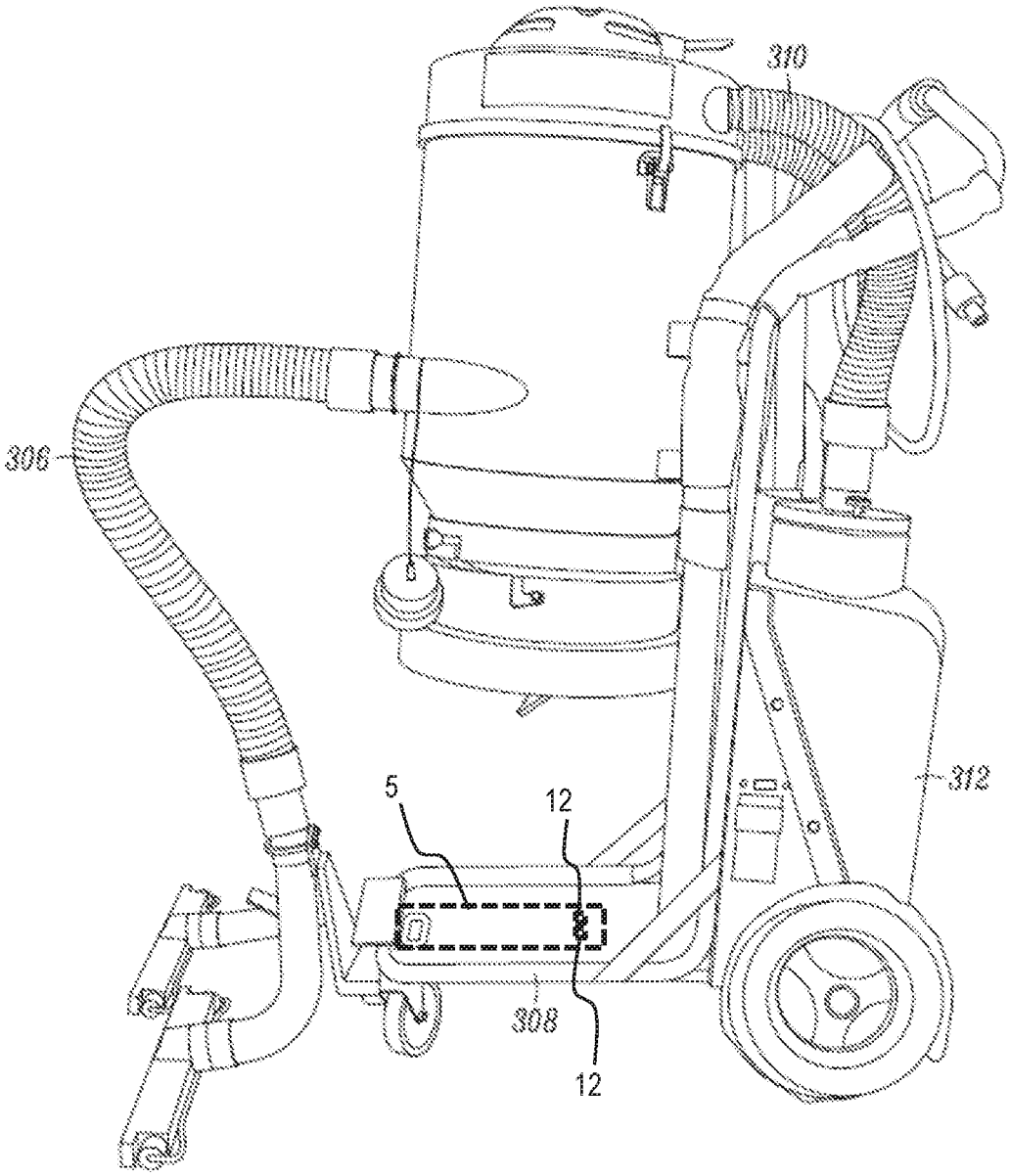
FIG. 2F is a side view of the apparatus of FIG. 2B secured to an undersurface of the vacuum.
Figure 3A:
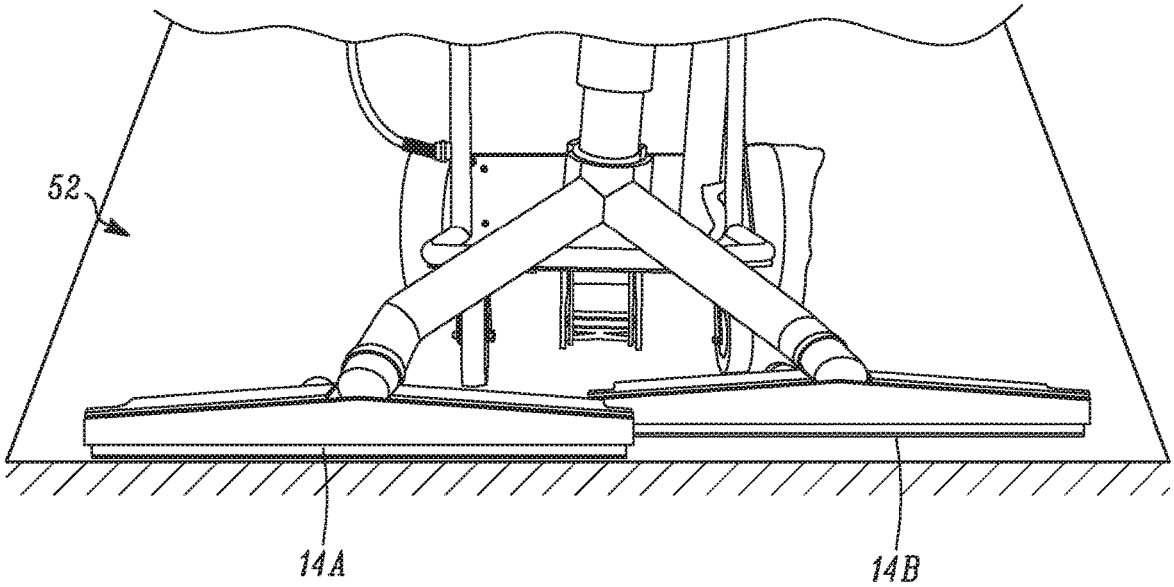
FIG. 3A is a front view of the apparatus of FIG. 2A with the pair of floor tools in a lowered position, according to one embodiment.
Figure 3B:
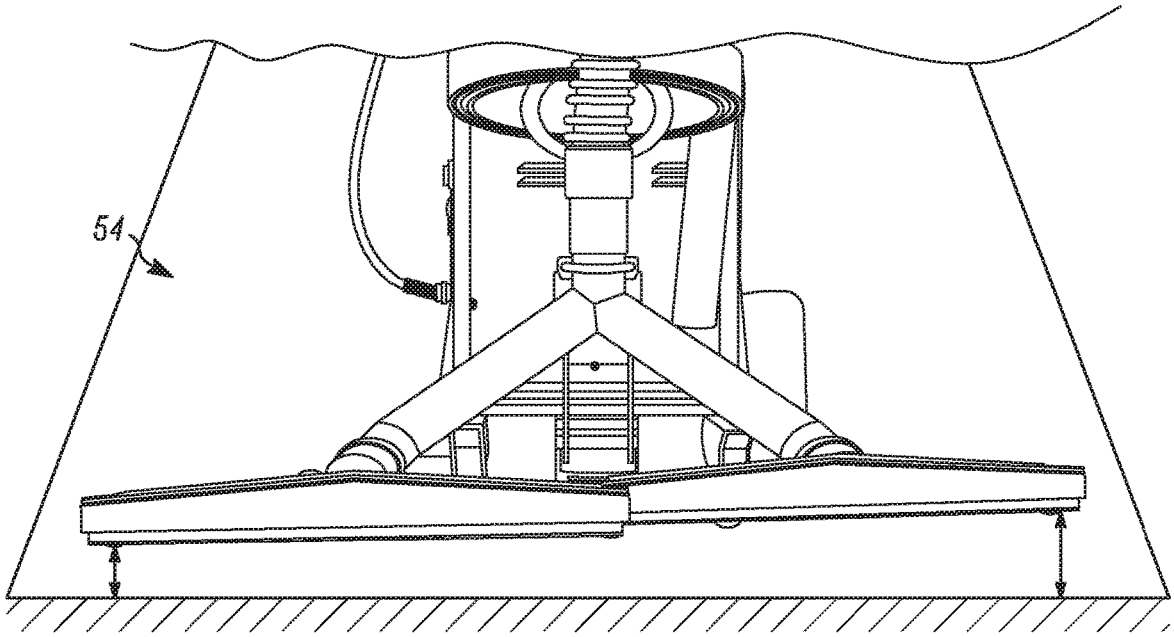
FIG. 3B is a front view of the apparatus of FIG. 2A with the pair of floor tools in a raised position, according to one embodiment.

FIG. 3A is a front view of the apparatus 50 of FIG. 2A with the pair of floor tools 14*a*, 14*b* in a lowered position 52, according to one embodiment. Although FIGS. 3A-3B depict the apparatus 50 attached to a frame of the vacuum 300 in the lowered position 52 and raised position 54, the apparatus 50 can be similarly attached to a frame of any wheeled vehicle, including the vacuum and pre-separators discussed herein and depicted in FIGS. 2A-3F. Although FIG. 3A depicts a pair of floor tools 14*a*, 14*b* attached with the apparatus 50, the embodiments of the invention is not limited to this arrangement and includes an apparatus that attaches one floor tool or more than two floor tools to a frame of a vacuum or pre-separator. FIG. 3B is a front view of the apparatus 50 of FIG. 2A with the pair of floor tools 14*a*, 14*b* in a raised position 54, according to one embodiment. In some embodiments, the floor tools 14*a*, 14*b* are moved to the lowered position 52 in order to vacuum dust off the floor surface. In the lowered position 52, the floor tools 14*a*, 14*b* advantageously "float" or freely move up and down, in accordance with the slope or trajectory of the floor surface. The floor tools 14*a*, 14*b* advantageously "float" or freely move up and down, regardless of whether the apparatus 50 is attached to a frame of the vacuum 300 or to a frame of any other vacuum or pre-separator discussed herein or depicted in FIGS. 2A-3F. In some embodiments, the floor tools 14*a*, 14*b* are moved to the raised position 54 when the vacuum 300 is moved from a first location to a second location and the user does not intend to vacuum a floor surface between the first location and the second location. In other embodiments, the floor tools 14*a*, 14*b* are moved to the raised position 54 after the floor tools 14*a*, 14*b* have finished vacuuming the floor surface in a location.

Figure 3C:
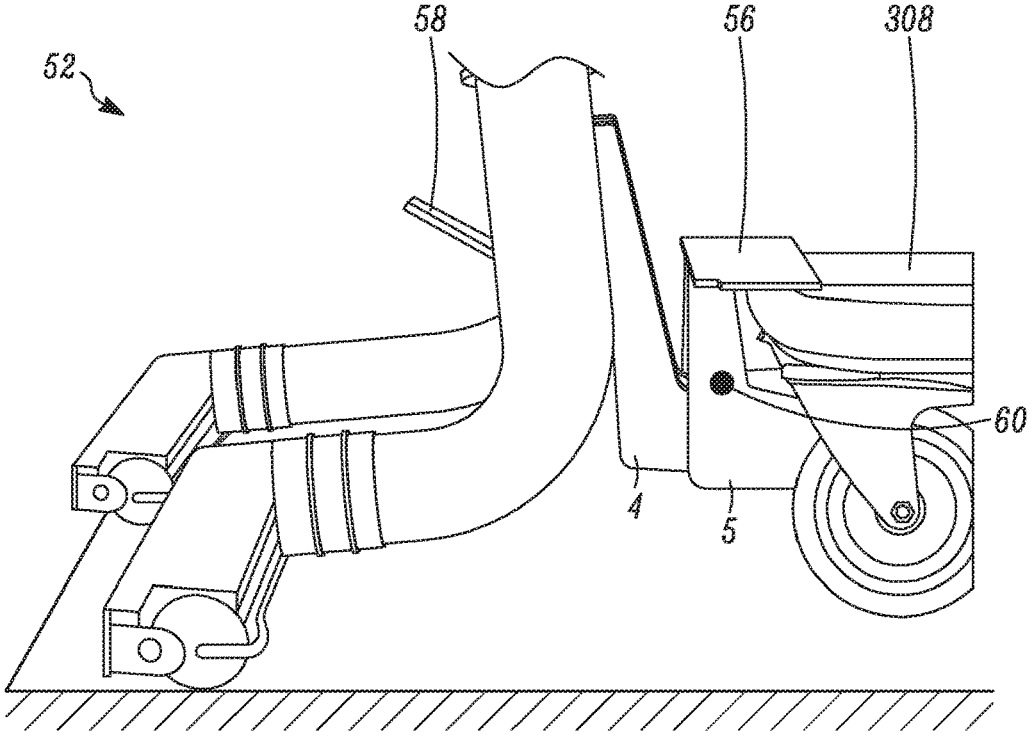
FIG. 3C is a side view of the apparatus of FIG. 3A with the pair of floor tools in the lowered position.

FIG. 3C is a side view of the apparatus 50 of FIG. 3A with the pair of floor tools 14*a*, 14*b* in the lowered position 52.

In some embodiments, the apparatus 50 includes a floatable frame 4 that is rotatably fixed within a mounting frame 5. In the lowered position 52, the floatable frame 4 is free to pivot or rotate within the mounting frame 5, so that the floor tools 14*a*, 14*b* can advantageously raise or lower in accordance with the slope of the floor. In some embodiments, the mounting frame 5 includes a member 56 that is secured to the frame 302 of the vacuum 300. In an example embodiment, the member 56 is an L-shaped member that is sized and shaped to hook to around a step 308 around a base of the frame 302 of the vacuum 300.

Figure 3D:
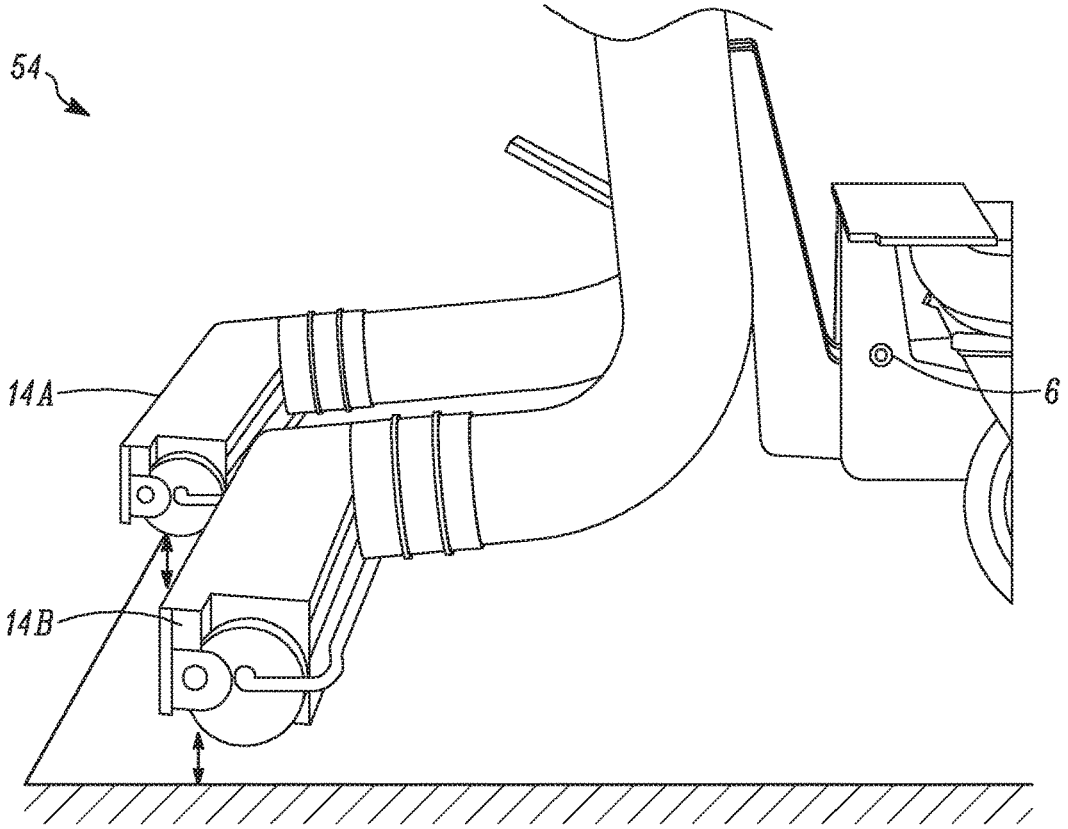
FIG. 3D is a side view of the apparatus of FIG. 3A with the pair of floor tools in the raised position.

FIG. 3D is a side view of the apparatus 50 of FIG. 3A with the pair of floor tools 14*a*, 14*b* in the raised position 54. In some embodiments, the apparatus 50 includes a foot pedal actuator 58 to be moved by a foot of a user, to move the apparatus 50 from the lowered position 52 (FIG. 3C) to the raised position 54 (FIG. 3D). In some embodiments, as the user pulls up on the foot pedal actuator 58, the floatable frame 4 rotates upward within the mounting frame 5 until spring-loaded balls 6 press outward into ball pockets 60 along the mounting frame 5. When the spring-loaded balls 6 press outward into the ball pockets 60, the apparatus 50 is locked in the raised position 54, so that the user can move the vacuum 300 from a first location to a second location while the floor tools 14*a*, 14*b* are not in contact with the floor surface. In an embodiment, the user raises the apparatus 50 to the raised positioned 54 when the user wants to transport the vacuum 300 from the first location to the second location and does not intend to vacuum a floor surface between the first and second locations.

The apparatus 50 improves the efficiency of dust pickup substantially more than using a hand tool since the user of a hand tool is not able to ergonomically or naturally hold the wand in a perfect horizontal position that is perfectly parallel to the floor. The apparatus 50 is configured such that the floor tools 14*a*, 14*b* float over the floor in a horizontal position and is able to follow the undulations in the floor as the floor tools 14*a*, 14*b* can float up and down and also swivel left and right. This is advantageous when vacuuming debris on a floor that is not perfectly level.

Figure 3E:
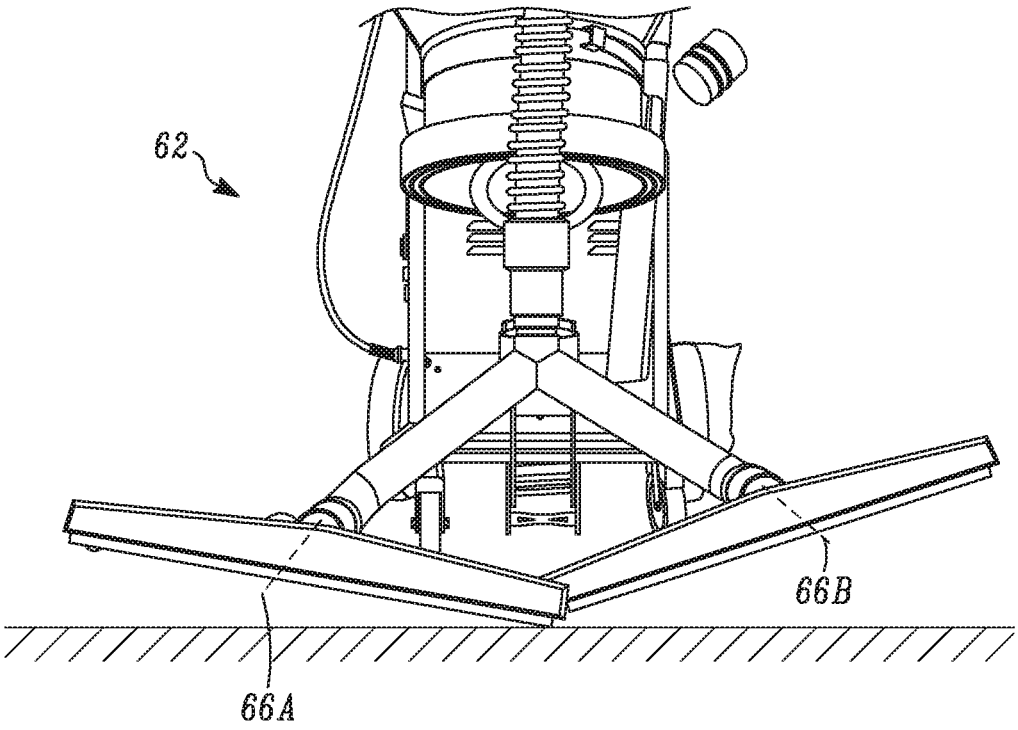
FIG. 3E is a front view of the apparatus of FIG. 2A with the pair of floor tools in an inwardly inclined position, according to one embodiment.

FIG. 3E is a front view of the apparatus 50 of FIG. 2A with the pair of floor tools 14*a*, 14*b* in an inwardly inclined position 62, according to one embodiment. In some embodiments, the floor tools 14*a*, 14*b* are independently rotatable about a respective axis of rotation, to adjust to independent undulations in the floor surface experienced by each floor tool 14*a*, 14*b*. In one embodiment, the floor tool 14*a* is rotatable about an axis of rotation 66*a* and the floor tool 14*b* is rotatable about an axis of rotation 66*b*. In one embodiment, the axes of rotations 66*a*, 66*b* are approximately parallel to one another and are approximately parallel to a direction of travel of the vacuum 300 over the floor surface. As depicted in FIG. 3E, the floor tools 14*a*, 14*b* rotate to an inwardly inclined position 62, such as where the floor surface has a trough between the floor tools 14*a*, 14*b*.

Figure 3F:
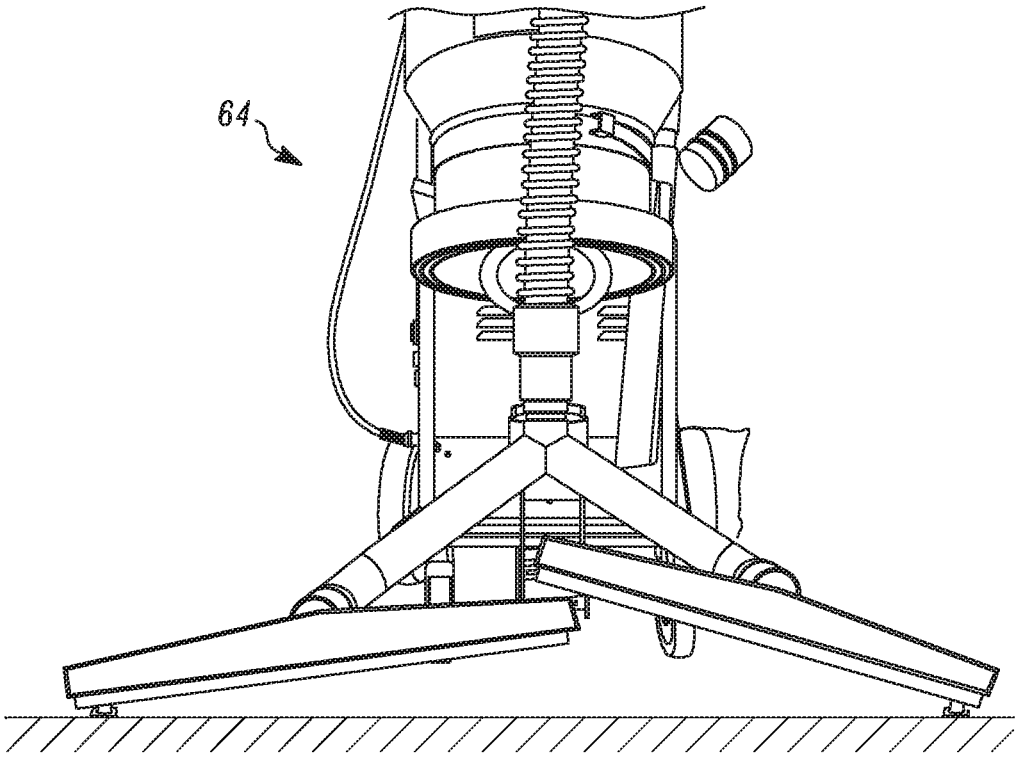
FIG. 3F is a front view of the apparatus of FIG. 2A with the pair of floor tools in an outwardly inclined position, according to one embodiment.

FIG. 3F is a front view of the apparatus 50 of FIG. 2A with the pair of floor tools 14*a*, 14*b* in an outwardly inclined position 64, according to one embodiment. In some embodiments, the floor tools 14*a*, 14*b* rotate to the outwardly inclined position 64, such as where the floor surface has a peak between the floor tools 14*a*, 14*b*. Although FIGS. 3E and 3F depict two different inclined positions of the floor tools 14*a*, 14*b*, the floor tools are not limited to these two inclined positions and are free to rotate to multiple inclined positions based on the undulations of the floor surface. Although FIGS. 3E-3F depict the apparatus 50 in the raised position 54, this is merely for illustrative purposes, since the floor tools 14*a*, 14*b* will experience these different undulations when traveling over the floor surface in the lowered position 52.

Figure 4A:
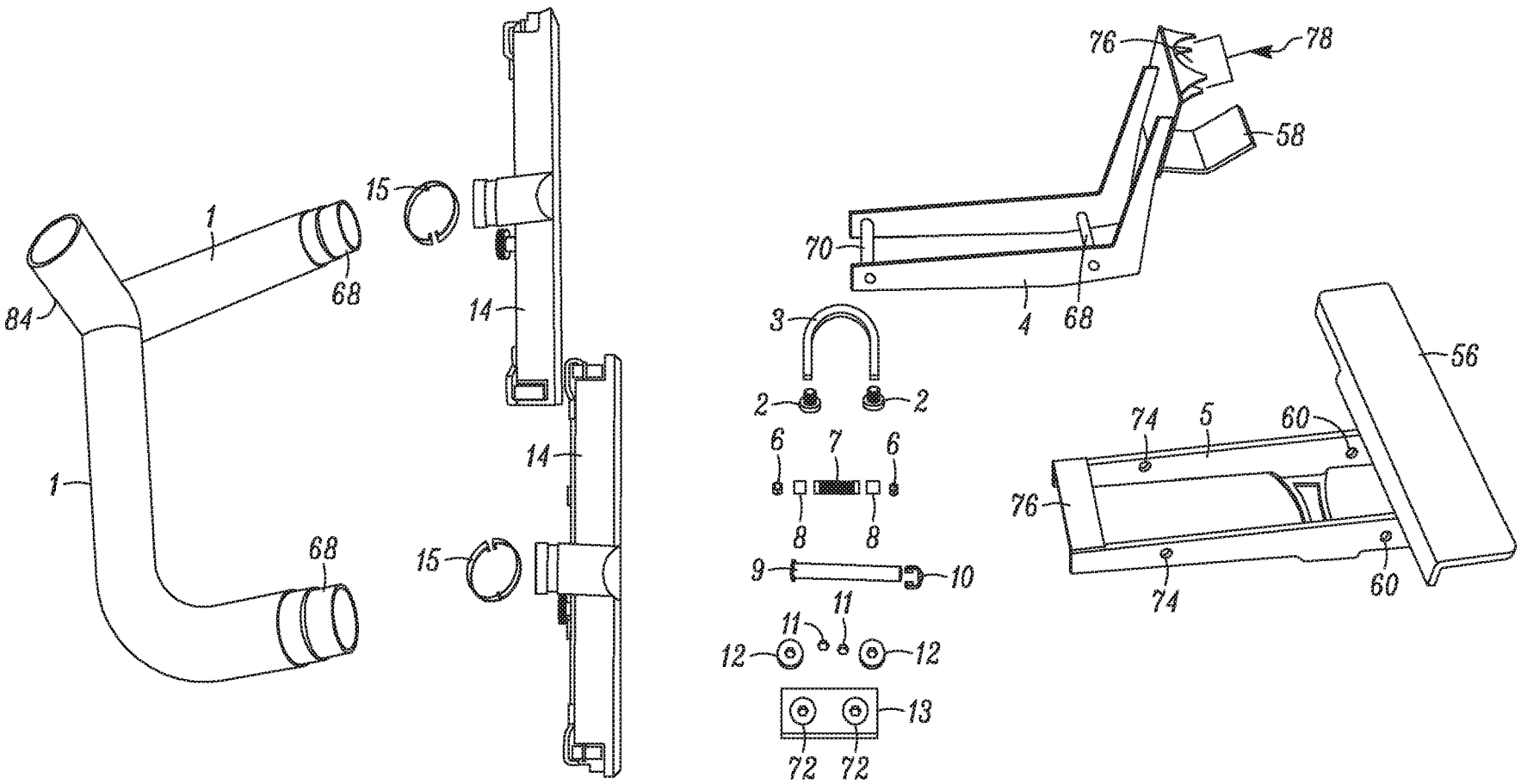
FIG. 4A is an exploded view that illustrates an example of the apparatus of FIGS. 2A-3F, according to one embodiment.
Figure 5:
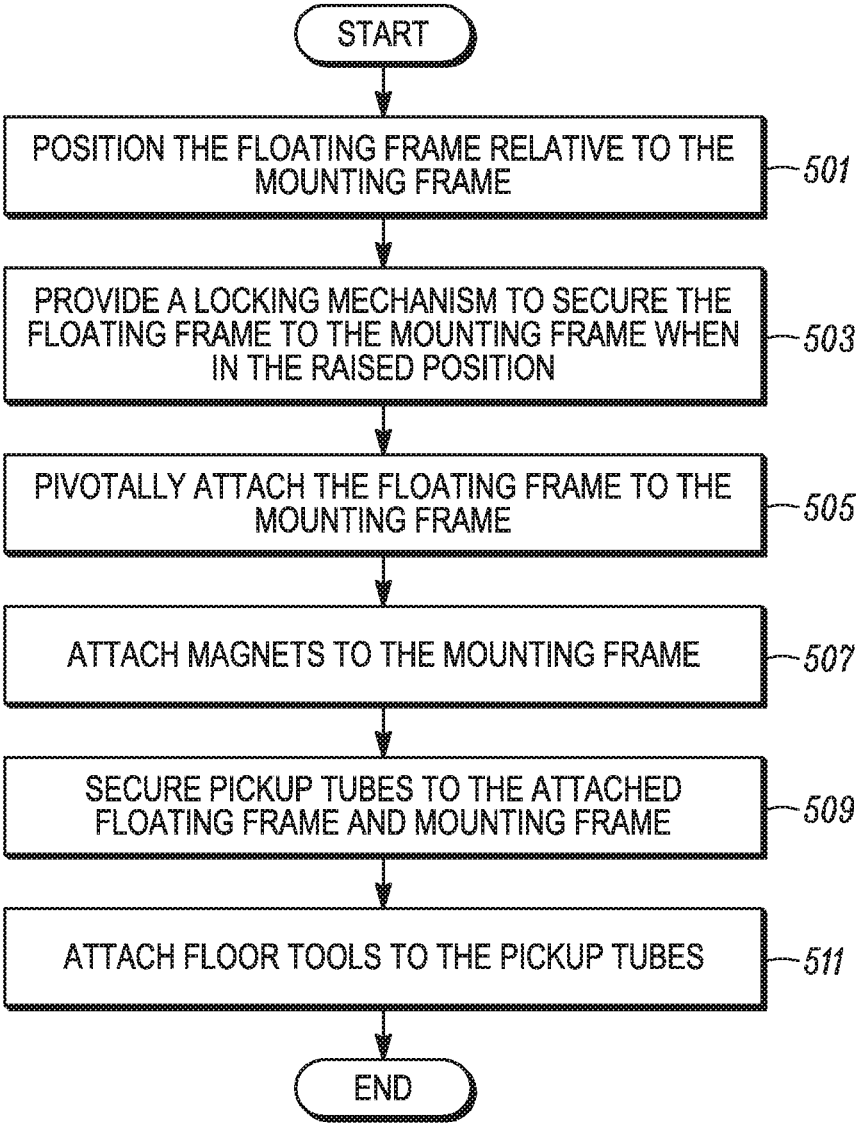
FIG. 5 is a flowchart that illustrates an example of a method for assembly the apparatus of FIGS. 4H-4I, according to an embodiment.
Figure 6:
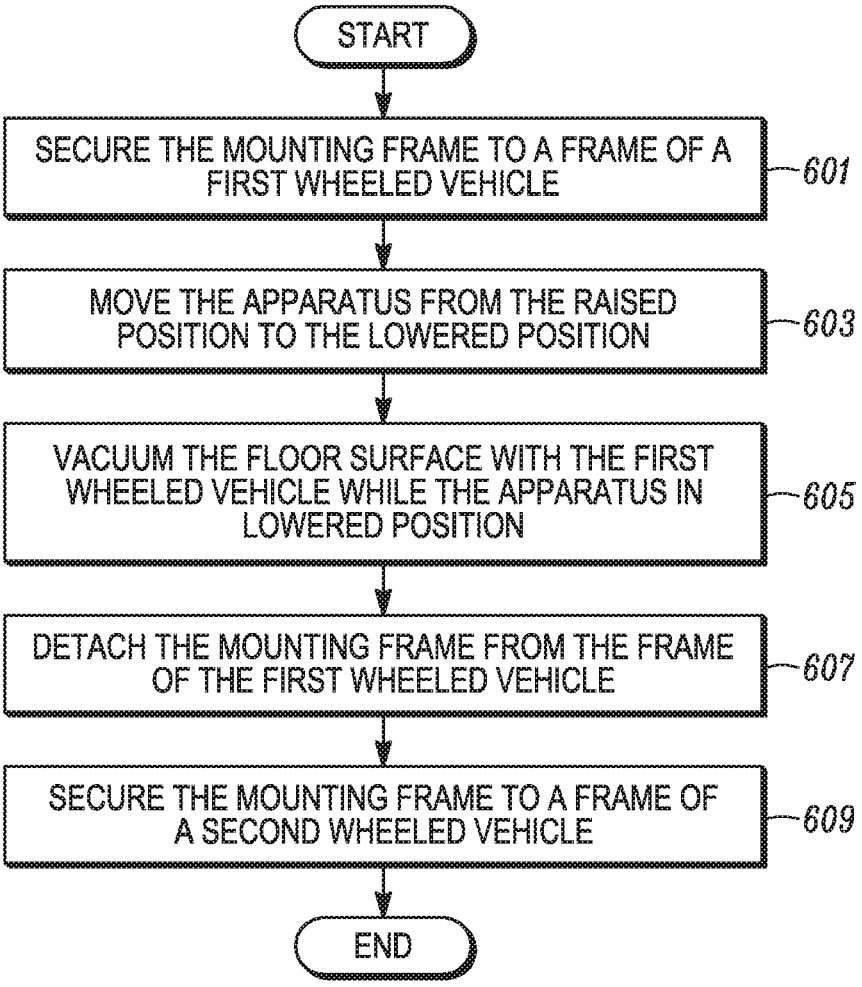
FIG. 6 is a flowchart that illustrates an example of a method for using the apparatus of FIGS. 4H-4I with a wheeled vehicle, according to an embodiment.

FIG. 4A is an exploded view that illustrates an example of the apparatus 50 of FIGS. 2A-3F, according to one embodiment. FIG. 5 is a flowchart that illustrates an example of a method 500 for assembling the apparatus 50 of FIGS. 4H-4I, according to an embodiment. Although steps are depicted in FIGS. 5 and 6 as integral steps in a particular order for purposes of illustration, in other embodiments, one or more steps, or portions thereof, are performed in a different order, or overlapping in time, in series or in parallel, or are omitted, or one or more additional steps are added, or the method is changed in some combination of ways.

The method 500 for assembling the apparatus 50 will now be discussed, with reference to each component of the apparatus 50 depicted in FIG. 4A. Although FIG. 4A depicts one embodiment where the apparatus 50 includes a pair of pickup tubes 1 with a respective pair of floor tool adapters 68 to attach to the pair of floor tools 14*a*, 14*b*, the embodiments of the invention is not limited to this arrangement and the apparatus can include more than two pickup tubes 1 with more than two floor tool adapters 68 to attach to more than two floor tools 14. In another embodiment, the apparatus can include one pickup tube 1 with one floor tool adapter 68 to attach to one floor tool 14.

Figure 4B:
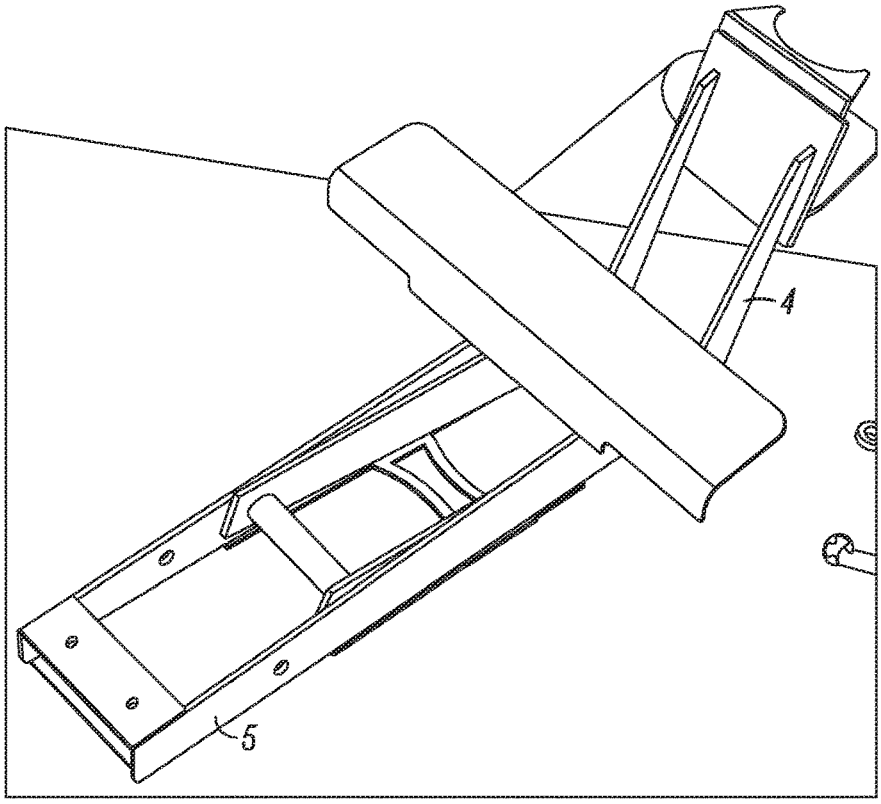
FIG. 4B is a top perspective view that illustrates an example of a floating frame positioned within a mounting frame of the apparatus of FIG. 4A.

As depicted in FIG. 4B, in a first assembly step 501, the floating frame 4 is positioned relative to the mounting frame 5. In one embodiment, in step 501 the floating frame 4 is positioned within the mounting frame 5. In an example embodiment, in step 501, the floating frame 4 is slid approximately half way within the mounting frame 5, as depicted in FIG. 4B.

Figure 4C:
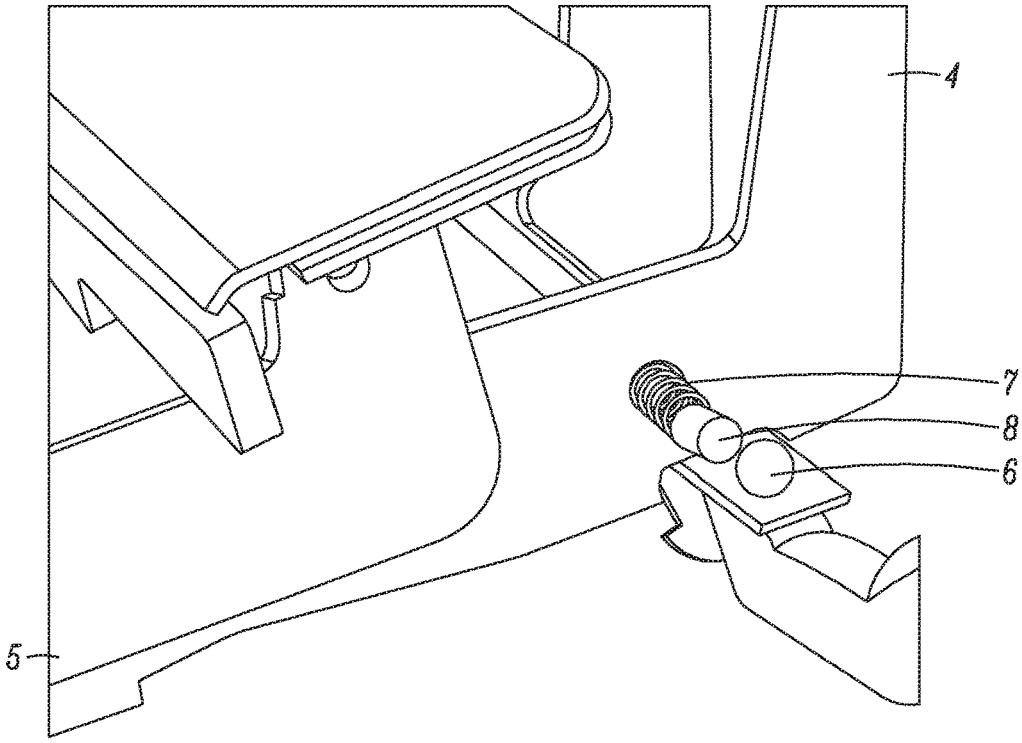
FIG. 4C is a side perspective view that illustrates an example of a ball, spring and spacer positioned in a retainer tube of the floating frame of FIG. 4B.

As depicted in FIG. 4C, in a second assembly step 503, a locking mechanism is provided to secure the floating frame 4 to the mounting frame 5 when the apparatus 50 is in the raised position 54. In one embodiment, in step 503, a detent ball spring 7 is inserted into a spring retainer tube 69 of the floating frame 4. Additionally, as depicted in FIG. 4C, detent ball spacers 8 are positioned on either end of the detent ball spring 7. Additionally, as depicted in FIG. 4C, detent balls 6 are positioned on an outside of each detent ball spacer 8. In one embodiment, the detent balls 6 and detent ball spacers 8 on each end of the spring 7 are pressed inward into the spring retainer tube 69 until the balls 6 are flush with the floating frame 4. The floating frame 4 is then slid within the mounting frame 5 so that the spring retainer tube 69 is aligned with the detent ball pockets 60 of the mounting frame 5. The floating frame 4 is slid within the mounting frame 5 until the balls 6 extend out into the detent ball pockets 60 of the mounting frame 5. In an example embodiment, the detent ball pockets 60 are chamfered, to accommodate the spring-loaded balls 6 slipping into the pockets 60. In one embodiment, the balls 6 and pockets 60 are sized, such that a diameter of the pockets 60 is smaller than a diameter of the balls 6. This relationship ensures that the spring-loaded balls 6 effectively extend into the pockets 60 to lock the apparatus 50 in the raised position 54 without passing through the pockets 60. Although the spring-loaded balls 6 and pockets 60 are discussed as one embodiment for locking the apparatus 50 in the raised position 54, the embodiments of the present invention is not limited to this arrangement and includes any locking mechanism for securing the floating frame 4 to the mounting frame 5, when the apparatus 50 is moved to the raised position 54, in order to lock the apparatus 50 in the raised position 54. In other embodiments, in step 503, the locking mechanism is a first magnet positioned on the floating frame 4 and a second magnet positioned on the mounting frame 5. In one embodiment, the first magnet is positioned at an equivalent location of the balls 6 and the second magnet is positioned at an equivalent location of the pockets 60. During operation, when the apparatus 50 is in the lowered position 52, the floating frame 4 "floats" within the mounting frame 5 and the first magnet raises and lowers, based on undulations in the floor surface. When the apparatus 50 is moved to the raised position 54, the first magnet of the floating frame 4 is magnetically secured to the second magnet of the mounting frame 5, to lock the apparatus 50 in the raised position 54. In some embodiments, the first magnet and second magnet embodiment is used where the apparatus 50 has increased weight, such as an apparatus 50 featuring more than two floor tool adapters 68.

Figure 4D:
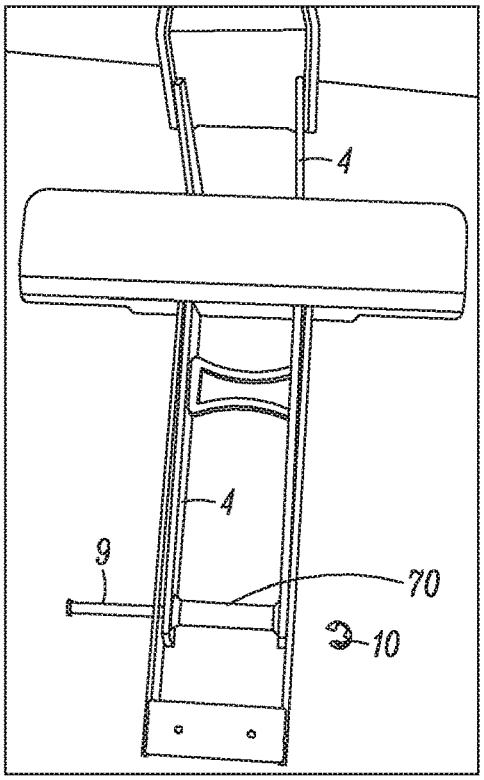
FIG. 4D is a top view that illustrates an example of a pin inserted within a pivot tube of the floating frame of FIG. 4B.
Figure 4E:
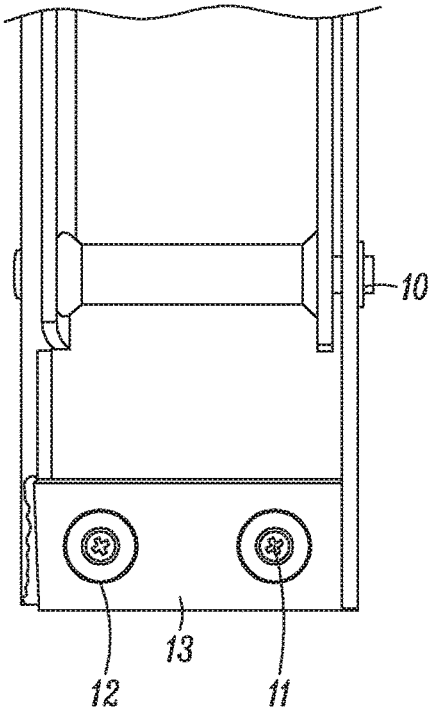
FIG. 4E is a top view of that illustrates an example of a pair of magnets mounted to one end of the mounting frame of FIG. 4B.

In a third assembly step 505, the floating frame 4 is movably attached to the mounting frame 5. In one embodiment, in step 505, the floating frame 4 is pivotally or rotatably attached to the mounting frame 5. In other embodiments, in step 505, the floating frame 4 is movably attached to the mounting frame 5 for linear movement with respect to the mounting frame 5. In one embodiment, in step 505 clevis pin inserts 74 (FIG. 4A) of the mounting frame 5 are aligned with a pivot frame tube 70 of the floating frame 4. As depicted in FIG. 4D, a clevis pin 9 is then inserted through the clevis pin inserts 74 and the pivot frame tube 70. As depicted in FIG. 4E, an E-clip 10 is then installed on an end of the clevis pin 9 that extends through the pivot frame tube 70. This step 505 pivotally attaches the floating frame 4 within the mounting frame 5 about an axis defined by the pivot frame tube 70.

In a fourth assembly step 507, as depicted in FIG. 4E, magnets are attached to the mounting frame 5. In one embodiment, the magnets are attached to one end of the mounting frame 5, where the end of the mounting frame 5 is attached to an undersurface of the wheeled vehicle. In one embodiment, in step 507, rare earth magnets 12 are positioned in spot holes 72 (FIG. 4A) of a rare earth magnet retainer 13. The rare earth magnets 12 and the retainer 13 are secured to the mounting frame 5 with hold down screws 11 that are passed through the magnets 12 and retainer 13 are received within openings in the mounting frame 5. In some embodiments of the method 500, step 507 is omitted.

Figure 4F:
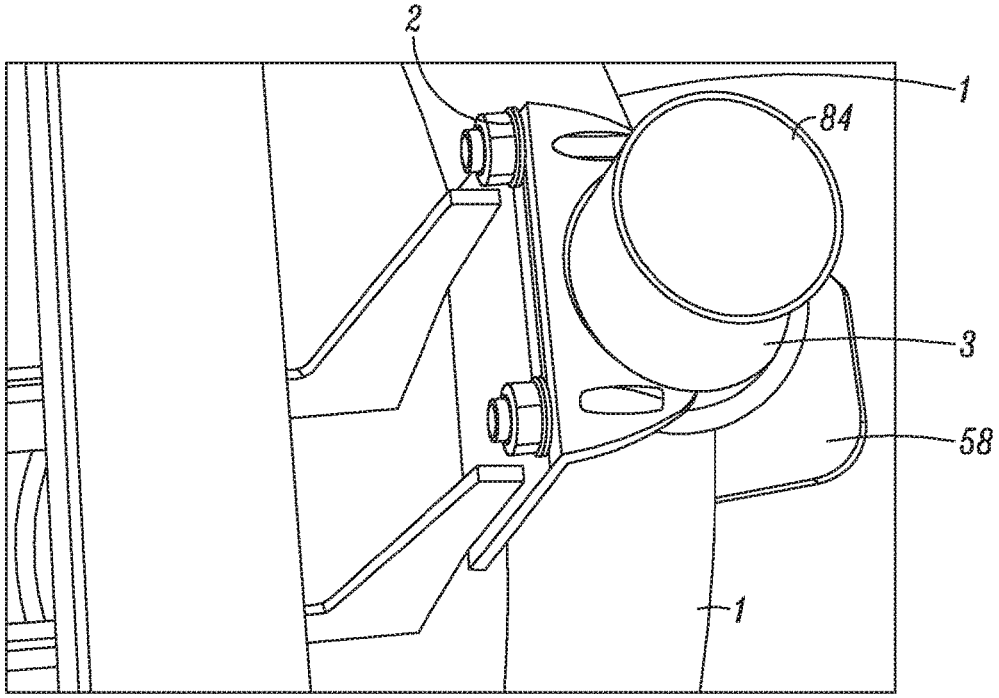
FIG. 4F is a top perspective view that illustrates an example of a U-bolt that secures a pair of tubes to the floating frame of FIG. 4B.

As depicted in FIG. 4A, the apparatus 50 includes a pair of pickup tubes 1 that merge at a junction tube 84. In a fifth assembly step 509, as depicted in FIG. 4F, the pair of pickup tubes 1 are secured to the attached frame 4, 5. In one embodiment, in step 509, the junction tube 84 is positioned in a U-bolt retainer spot 76 (FIG. 4A). A U-bolt 3 is then installed into U-bolt retainer slots 78 (FIG. 4A) using two U-bolt nuts 2. In other embodiments, more than two U-bolt nuts can be used.

Figure 4G:
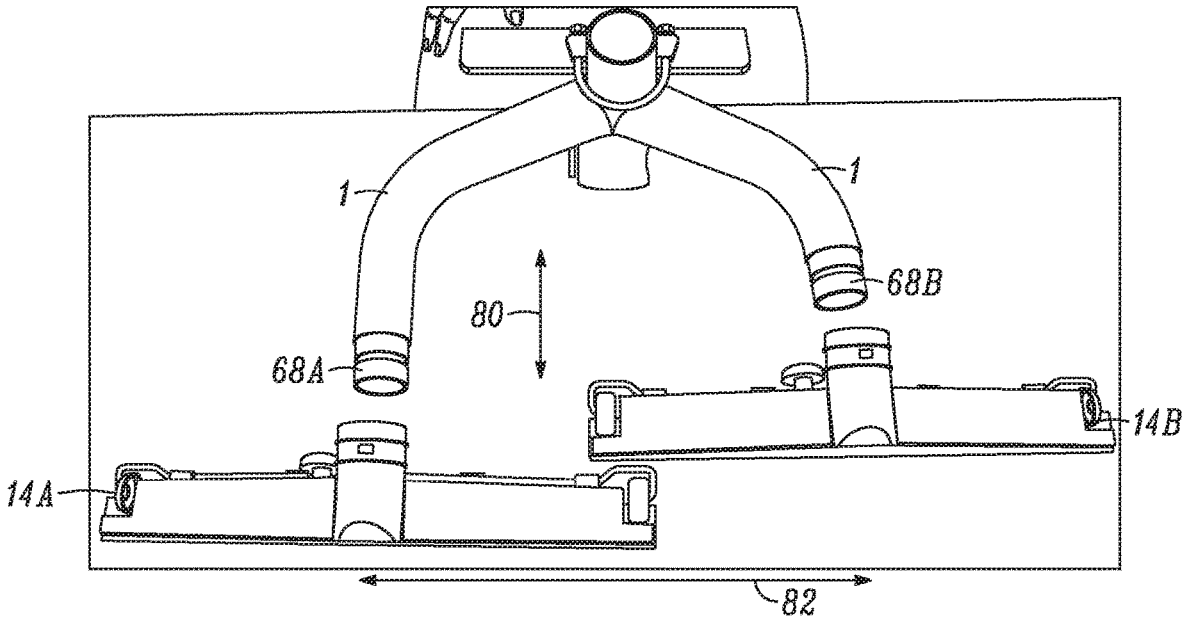
FIG. 4G is a top view that illustrates an example of a pair of floor tools to be secured to the pair of tubes of FIG. 4F.

As depicted in FIG. 4G, in a sixth assembly step 511, the floor tools 14*a*, 14*b* are attached to the pair of pickup tubes 1. In one embodiment, in step 511, the floor tools 14*a*, 14*b* are attached to respective floor tool adapters 68*a*, 68*b*. In some embodiments, the floor tools 14*a*, 14*b* are attached to the floor tool adapters 68*a*, 68*b* using plastic clips 15 (FIG. 4A). In some embodiments, the floor tools 14*a*, 14*b* are not part of the apparatus 50. As depicted in FIG. 4G, in some embodiments, the floor tool adapters 68*a*, 68*b* of the apparatus 50 have a longitudinal offset 80 and a lateral offset 82. In some embodiments, the longitudinal offset 80 is in a direction of travel of the vacuum over the floor surface, whereas the lateral offset 82 is in an orthogonal direction to a direction of travel of the vacuum over the floor surface. In an example embodiment, the longitudinal offset 80 is about 8.9 centimeters (cm) or in a range of about 5.08 cm-15.24 cm. In another example embodiment, the lateral offset 82 is about 40.64 cm or in a range of about 30.48 cm-50.8 cm. In an example embodiment, the length of the floor tool 14*a*, 14*b* is about 45.72 cm. In some embodiments, the longitudinal offset 80 is adjusted, such that a minimum spacing is achieved in the longitudinal direction (i.e. in the direction of travel) between the floor tools 14*a*, 14*b*. In an example embodiment, the minimum longitudinal spacing is about 1.27 cm. In some embodiments, the lateral offset 82 is adjusted, based on the length of the floor tool 14*a*, 14*b*. In one embodiment, the lateral offset 82 is adjusted, to be less than the length of the floor tool 14*a*, 14*b*. In an example embodiment, the lateral offset 82 is adjusted to be about 5.08 cm less than the length of the floor tool 14*a*, 14*b*. This advantageously ensures that the floor tools 14*a*, 14*b* overlap (see FIG. 4G) so that the floor surface is completely vacuumed. The inventors of the present invention recognized that if the floor tools 14*a*, 14*b* did not overlap, a region of the floor surface between the floor tools 14*a*, 14*b* would not be completed vacuumed.

Figure 4H:
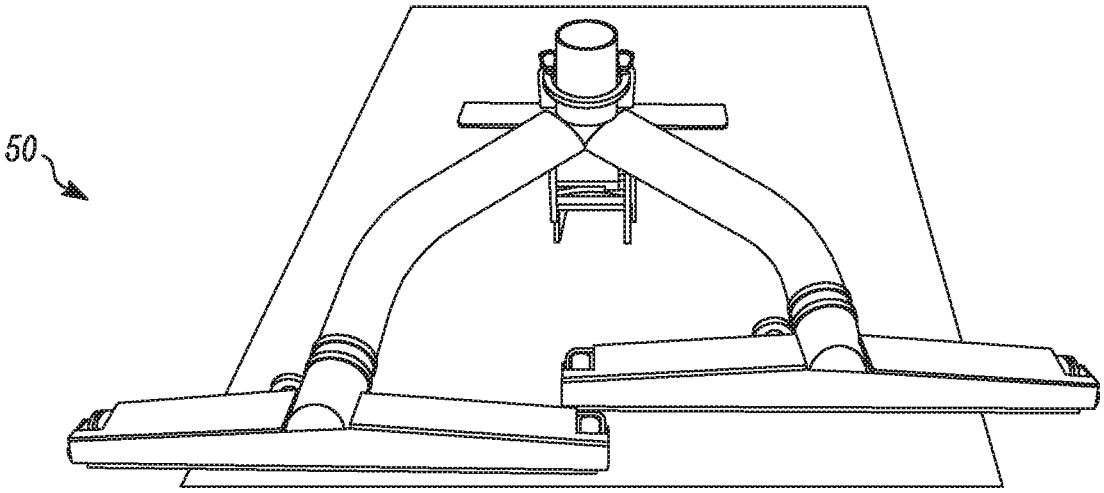
FIG. 4H is a front perspective that illustrates an example of the apparatus of FIGS. 2A-3F.
Figure 4I:
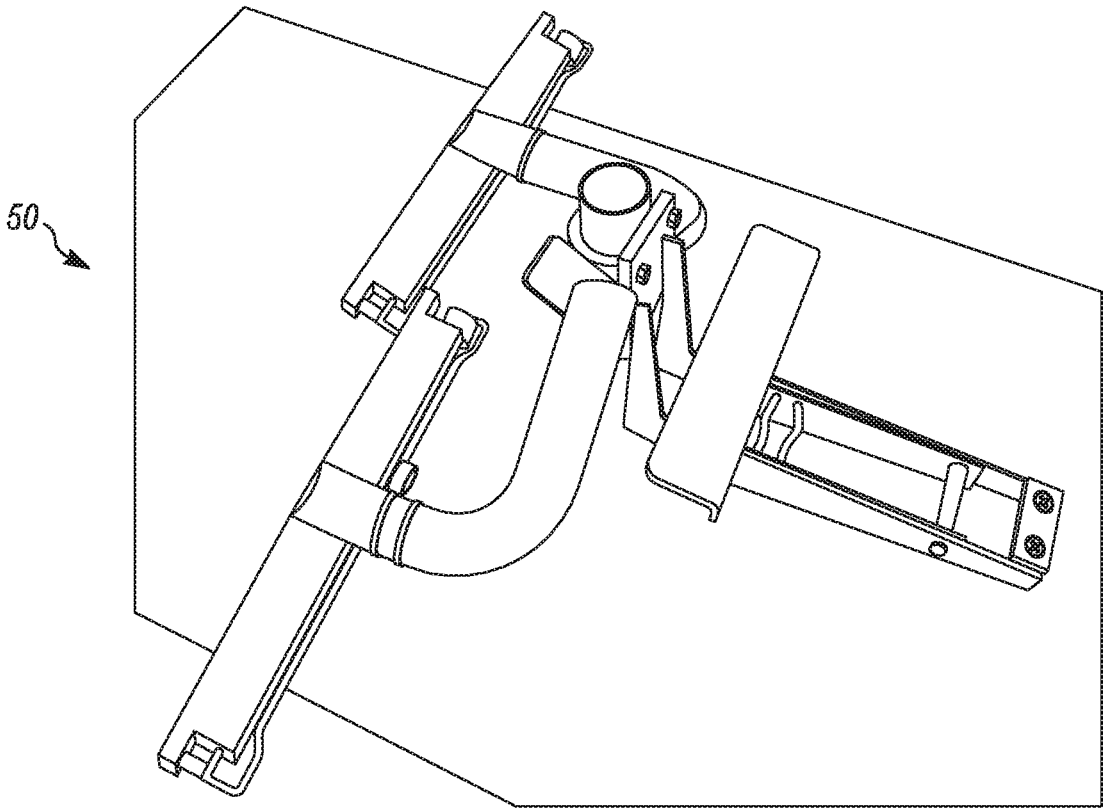
FIG. 4I is a side perspective view that illustrates an example of the apparatus of FIG. 4H.

FIG. 4H is a front perspective that illustrates an example of the apparatus 50 after assembly. FIG. 4I is a side perspective view that illustrates an example of the apparatus 50 after assembly.

A method will now be discussed to attach the apparatus 50 to a wheeled vehicle (e.g. vacuum or pre-separator). FIG. 6 is a flowchart that illustrates an example of a method 600 for using the apparatus 50 of FIGS. 4H-4I with a wheeled vehicle, according to an embodiment. In some embodiments, the method 600 is for attaching the apparatus 50 to a frame of the wheeled vehicle. In other embodiments, the method 600 is for attaching the apparatus 50 to the frame of the wheeled vehicle and subsequently using the apparatus 50 with the wheeled vehicle. In still other embodiments, the method 600 is for using the apparatus 50 with the wheeled vehicle. In some embodiments, an advantage of this method 600 is that it can be performed without the need for tools. After the apparatus 50 is assembled using the method 500 above, in a first step 601 the mounting frame 5 is secured to the frame of the wheeled vehicle. In one embodiment, in step 601, the member 56 of the mounting frame 5 is secured to the frame 302 of the vacuum 300. In an example embodiment, the member 56 is an L-shaped member that is hooked around the step 308 (FIG. 2C, FIG. 3C) that surrounds a perimeter of a base of the frame 302.

In another embodiment, in step 601, the mounting frame 5 is secured to an undersurface of the wheeled vehicle. In one embodiment, in step 601, after the member 56 is secured to the frame 302, the magnets 12 secured to the mounting frame 5 are contacted (e.g. magnetically secured) to an undersurface of the frame 302, (as shown in FIG. 2F). In other embodiments, in step 601, the mounting frame 5 excludes the magnets 12 and instead one end of the mounting frame 5 (e.g. without magnets 12) is contacted to the undersurface of the frame 302.

After the apparatus 50 is attached to the vacuum 300, in step 603 the apparatus 50 is moved from the raised position 54 to the lowered position 52. In one embodiment, in step 603, the user adjusts the foot pedal actuator 58, to move the apparatus 50 between the raised position 54 (FIG. 3D) and the lowered position 52 (FIG. 3C) to vacuum the floor surface. In one embodiment, in step 605, the user vacuums the floor surface with the wheeled vehicle while the apparatus 50 is in the lowered position 52. In one embodiment, in step 605, the floor tools 14*a*, 14*b* rotate about respective axes 66*a*, 66*b* to the inwardly inclined position 62 (FIG. 3E) based on a trough in the floor surface between the floor tools 14*a*, 14*b*. In another embodiment, in step 605, the floor tools 14*a*, 14*b* rotate about respective axes 66*a*, 66*b* to the outwardly inclined position 64 (FIG. 3F) based on a peak in the floor surface between the floor tools 14*a*, 14*b*. The apparatus 50 can be secured to a frame of any vacuum or pre-separator using a similar method as that discussed above.

In some embodiments, where the user wants to remove the apparatus 50 from a first wheeled vehicle (e.g. first vacuum) and attach the apparatus 50 to a second wheeled vehicle (e.g. second vacuum), in step 607 the mounting frame is detached from the undersurface of the first wheeled vehicle. In one embodiment, in step 607, the magnets 12 are separated from the undersurface of the frame 302, so that the magnets 12 no longer contacts the undersurface of the frame 302. In another embodiment, in step 607, the mounting frame is detached from the frame of the first wheeled vehicle. In one embodiment, in step 607, the member 56 is unhooked from the step 308 of the frame 302 and the apparatus 50 is removed from the vacuum frame 302. In one embodiment, step 607 is advantageously performed without the need for tools. In step 609, the apparatus 50 is secured to a second wheeled vehicle using similar techniques as in step 601. In one embodiment, steps 607 and 609 are advantageously performed without the need for tools.

In some embodiments of the method 600, where the apparatus 50 is secured to a frame of the wheeled vehicle, step 601 is performed and the remaining steps may be omitted. In other embodiments, where the apparatus 50 is secured to the frame of the wheeled vehicle and the wheeled vehicle is used to vacuum a floor surface, steps 601, 603, 605 are performed and the remaining steps may be omitted. In yet other embodiments, where the apparatus 50 is just removed from a first wheeled vehicle and attached to a second wheeled vehicle, steps 607 and 609 are performed and the other steps may be omitted.

Once the apparatus 50 is attached to the vacuum or pre-separator, the purpose of the apparatus 50 is to permit the user to vacuum debris off the floor by moving the vacuum or vacuum and pre-separator as one entire unit. In some embodiments, the apparatus 50 is attached to a combined frame of multiple wheeled vehicles, such as a frame of a combined vacuum and pre-separator, where the vacuum is connected downstream of the pre-separator.

One advantage of using the apparatus 50 is elimination of the requirement of the user from using a hand held vacuum wand with an attached hose. As appreciated by one skilled in the art, a conventional hand held vacuum requires the user to move the vacuum to a first area, after which the user moves the hand held vacuum wand within the first area before the user moves the vacuum to a second area. With the apparatus 50, the user simply moves the vacuum and the floor tools as one unit as the floor tools vacuum debris as the user moves around.

Another advantage of the apparatus 50 is that it accommodates two or more floor tools 14 being attached to the vacuum frame, depending on the model as opposed to the single tool 102 that is used in the conventional squeegee vacuum 100.

Another advantage of the apparatus 50 is in the context of concrete grinding. As appreciated by one skilled in the art, during concrete grinding, it is common to have a separate vacuum attached to the grinder to minimize the amount of dust left on the floor. However, it is inevitable that additional dust remains. It would be advantageous for a user to obtain an additional vacuum and secure floor tools 14 to the vacuum frame with the apparatus 50, so that a user can follow behind the concrete grinder and pick up any remaining dust left on the floor. In some embodiments, the user can obtain an additional vacuum and secure the floor tools 14 to the additional vacuum with the apparatus 50. As a first user moves the concrete grinder over a floor surface (and a first vacuum is attached to the grinder) a second user can push the additional vacuum with the attached apparatus 50 and floor tools 14 over the floor surface to pick up any remaining dust. In other embodiments, the user can simply purchase the apparatus 50 and attach the floor tools 14 to the same vacuum that was previously attached to the concrete grinder. This advantageously permits a user to use the same vacuum for multiple purposes with maximum efficiency and minimal cost.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. Throughout this specification, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the item, element or step modified by the article. As used herein, unless otherwise clear from the context, a value is "about" another value if it is within a factor of two (twice or half) of the other value. While example ranges are given, unless otherwise clear from the context, any contained ranges are also intended in various embodiments. Thus, a range from 0 to 10 includes the range 1 to 4 in some embodiments.

What is claimed is:

1. An apparatus for attaching a plurality of floor tools to a wheeled vehicle comprising a vacuum, comprising:

a mounting frame configured to secure to a frame of the wheeled vehicle;

a floating frame movably attached to the mounting frame;

a plurality of pickup tubes attached to the floating frame, said plurality of pickup tubes including a respective plurality of floor tool adapters positioned between the plurality of pickup tubes and the plurality of floor tools and configured to attach to the plurality of floor tools such that the plurality of floor tools are independently rotatable about respective axes of rotation based on undulations in the floor surface, wherein said respective axes of rotation are approximately parallel to a direction of travel of the wheeled vehicle over a floor surface, wherein the plurality of pickup tubes are configured to be in fluid communication with the vacuum; and a locking mechanism to secure the floating frame to the mounting frame when the apparatus is moved to a raised position from a lowered position;

wherein in the lowered position the floating frame and the plurality of pickup tubes are configured to float and move freely relative to the mounting frame based on the undulations in the floor surface over which the plurality of floor tools travel.

2. The apparatus as recited in claim 1, wherein the mounting frame includes a member that is sized and shaped to hook around a step at a base of the frame of the wheeled vehicle.

3. The apparatus as recited in claim 1, wherein the locking mechanism comprises:

a spring inserted into a spring retainer tube of the floating frame;

a pair of balls positioned at opposing ends of the spring in the spring retainer tube; and a pair of ball pockets defined by the mounting frame;

wherein in the raised position the spring retainer tube is aligned with the pair of ball pockets such that the pair of balls are configured to slide into the respective pair of ball pockets to secure the floating frame to the mounting frame.

4. The apparatus as recited in claim 3, wherein a diameter of the pair of ball pockets is smaller than a diameter of the pair of balls such that the pair of balls are configured to extend into the pair of ball pockets without passing through the pair of ball pockets.

5. The apparatus as recited in claim 1, wherein the floating frame is pivotally attached to the mounting frame based on a pivot frame tube of the floating frame being aligned with pin inserts of the mounting frame and a pin inserted through the pin inserts and into the pivot frame tube such that the floating frame is pivotally attached within the mounting frame about an axis defined by the pivot frame tube.

6. The apparatus as recited in claim 1, wherein at least one magnet is attached to an end of the mounting frame and wherein the at least one magnet is configured to secure the end of the mounting frame to an undersurface of the wheeled vehicle.

7. The apparatus as recited in claim 1, wherein the plurality of pickup tubes is a pair of pickup tubes, wherein the plurality of floor tool adapters is a respective pair of floor tool adapters configured to attach to the plurality of floor tools, and wherein the pair of floor tool adapters include a longitudinal offset in the direction of travel of the floor tools over the floor surface and a lateral offset in an orthogonal direction to the direction of travel of the floor tools over the floor surface.

8. The apparatus as recited in claim 7, wherein the longitudinal offset is greater than a minimum spacing and wherein the lateral offset is less than a length of the floor tool.

9. The apparatus as recited in claim 7, and wherein the pair of pickup tubes have varying length such that the pair of floor tool adapters include the longitudinal offset in the direction of travel of the floor tools over the floor surface.

10. The apparatus as recited in claim 1, wherein the at least one pickup tube is secured to the floating frame with a U-bolt.

11. The apparatus as recited in claim 1, wherein the plurality of pickup tubes are configured such that;

the plurality of floor tools are configured to rotate about the respective axes of rotation to an inwardly inclined position based on a trough in the floor surface between the plurality of floor tools; and the plurality of floor tools are configured to rotate about the respective axes of rotation to an outwardly inclined position based on a peak in the floor surface between the plurality of floor tools.

12. The apparatus as recited in claim 1, wherein the wheeled vehicle is configured to be moved by a user over the floor surface as the user moves over the floor surface.

13. The apparatus as recited in claim 1, wherein the mounting frame is configured to be attached and detached from the frame of the wheeled vehicle without tools.

14. A wheeled vehicle comprising:

the apparatus of claim 1; and the plurality of floor tools attached to the wheeled vehicle with the apparatus.

15. The wheeled vehicle as recited in claim 14, wherein the vacuum has a minimum suction capability of 150 cubic feet per minute (CFM).

16. The wheeled vehicle as recited in claim 14, wherein the wheeled vehicle comprises:

the vacuum including a high efficiency particulate air (HEPA) filter; and a pre-separator including a drum, said pre-separator connected to the vacuum with a duct;

and wherein the vacuum is connected by the duct downstream of the pre-separator such that suction is pulled through the pre-separator to remove a first amount of dust and heavier materials into a collection area below the drum such that the first amount of dust and heavier materials is removed upstream of the vacuum and does not pass to the vacuum.

17. The wheeled vehicle as recited in claim 14, wherein the plurality of floor tool adapters are configured to attach to the plurality of floor tools such that the plurality of floor tools have a longitudinal offset in the direction of travel of the floor tools and a lateral offset in an orthogonal direction to the direction of travel.

18. An apparatus for attaching a plurality of floor tools to a wheeled vehicle comprising a vacuum, comprising:

a mounting frame configured to secure to a frame of the wheeled vehicle;

a floating frame movably attached to the mounting frame;

a plurality of pickup tubes attached to the floating frame, said plurality of pickup tubes including a respective plurality of floor tool adapters positioned between the plurality of pickup tubes and the plurality of floor tools and configured to attach to the plurality of floor tools, wherein the plurality of pickup tubes are configured to be in fluid communication with the vacuum; and a locking mechanism to secure the floating frame to the mounting frame when the apparatus is moved to a raised position from a lowered position;

wherein in the lowered position the floating frame and the plurality of pickup tubes are configured to float and move freely relative to the mounting frame based on undulations in a floor surface over which the plurality of floor tools travel;

wherein the plurality of floor tool adapters include a longitudinal offset in a direction of travel of the floor tools over the floor surface and a lateral offset in an orthogonal direction to the direction of travel and wherein the plurality of pickup tubes have varying length such that the plurality of floor tool adapters include the longitudinal offset in the direction of travel of the floor tools over the floor surface.

19. A method for assembling the apparatus of claim 1, comprising: positioning the floating frame relative to the mounting frame; securing the floating frame to the mounting frame when the apparatus is in the raised position and wherein the at least one floor tool is not in contact with the floor surface in the raised position; pivotally attaching the floating frame to the mounting frame; and securing at least one of the plurality of pickup tube to the floating frame.

20. The method as recited in claim 19, wherein the securing step comprises providing the locking mechanism to perform the securing step; wherein the positioning step comprises sliding the floating frame within the mounting frame; and wherein the providing step comprises inserting a spring into a spring retainer tube of the floating frame, positioning spacers on either end of the spring, positioning balls on an outside of the spacers and pressing the balls inward until the balls are flush with the floating frame.

21. The method as recited in claim 19, wherein the pivotally attaching step comprises aligning pin inserts of the mounting frame with a pivot frame tube of the floating frame and inserting a pin through the pin inserts and into the pivot frame tube; and wherein the securing step comprises securing the at least one pickup tube to the floating frame with a U-bolt.

22. A method for using the apparatus of claim 1 with the wheeled vehicle, comprising securing the mounting frame to the frame of the wheeled vehicle.

23. The method as recited in claim 22, further comprising vacuuming the floor surface with the wheeled vehicle; wherein the securing the mounting frame to the frame of the wheeled vehicle comprises hooking a L-shaped member of the mounting frame around a step at a base of the frame of the wheeled vehicle; and wherein the wheeled vehicle is the vacuum and wherein the vacuuming step comprises cleaning a filter in the vacuum, and wherein the cleaning the filter step is performed while the vacuum is continuously running and is not turned off.

* * * * *